US007062217B2

(12) United States Patent
Tsukamoto et al.

(10) Patent No.: US 7,062,217 B2
(45) Date of Patent: Jun. 13, 2006

(54) IMAGE FORMATION DEVICE

(75) Inventors: Kazuyuki Tsukamoto, Nakai-machi (JP); Shin Takeuchi, Nakai-machi (JP); Katsumi Sakamaki, Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 181 days.

(21) Appl. No.: 10/703,228

(22) Filed: Nov. 7, 2003

(65) Prior Publication Data

US 2004/0190927 A1 Sep. 30, 2004

(30) Foreign Application Priority Data

Mar. 24, 2003 (JP) ..... 2003-080779

(51) Int. Cl.
*G03G 15/00* (2006.01)
*G03G 15/41* (2006.01)

(52) U.S. Cl. ..... 399/401; 399/197; 399/389

(58) Field of Classification Search ..... 399/401, 399/389, 364, 309, 197
See application file for complete search history.

(56) References Cited

FOREIGN PATENT DOCUMENTS

| | | | |
|---|---|---|---|
| JP | 03132673 A | * | 6/1991 |
| JP | 03138666 A | * | 6/1991 |
| JP | 4-288560 | | 10/1992 |
| JP | 10-149057 | | 6/1998 |
| JP | 2002-72771 | | 3/2002 |

* cited by examiner

*Primary Examiner*—Susan Lee
(74) *Attorney, Agent, or Firm*—Morgan, Lewis & Bockius, LLP

(57) ABSTRACT

An image formation device having a paper feed member which separates on a one-by-one basis sheets taken out of a paper feed tray by a take-out roller and feeds the separated sheets downstream in a sheet carrying direction; an upstream side sheet carrying path which the sheets are carried to an image recording position and which has a sheet size detecting path; an image recording member which records an image; a downstream side sheet carrying path which carries recorded sheets to an eject tray; and a sheet inverting path for inverting one side recorded sheets, and further having a sheet returning path for returning one side recorded sheets to the upstream side sheet carrying path; a sheet size detecting part which detects sheet sizes; an image magnification computing part which computes an image magnification, and an image recording member drive data output part which supplies image recording member drive data.

15 Claims, 23 Drawing Sheets

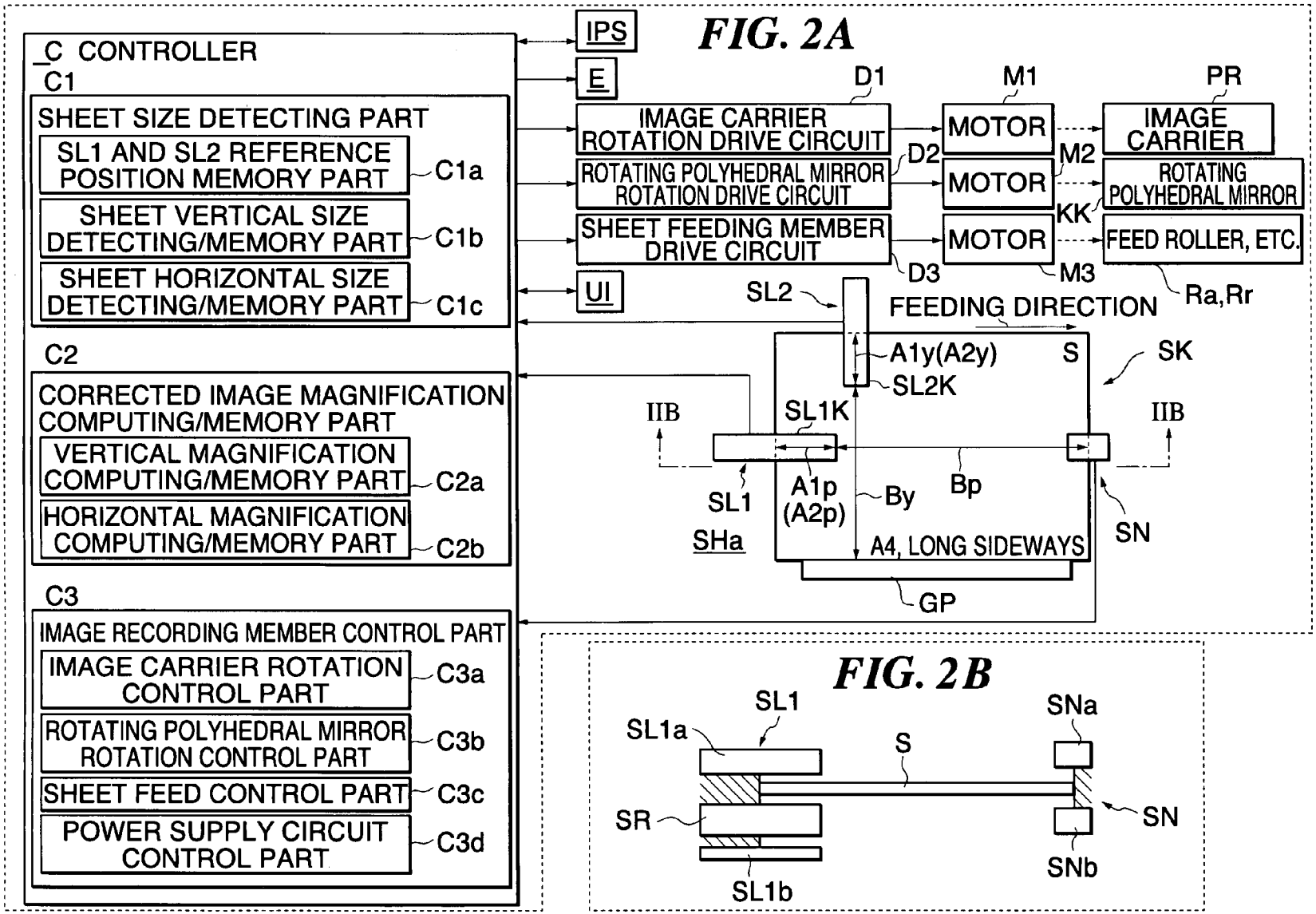
FIG. 2A
IPS
E
UI
IMAGE CARRIER ROTATION DRIVE CIRCUIT
ROTATING POLYHEDRAL MIRROR ROTATION DRIVE CIRCUIT
SHEET FEEDING MEMBER DRIVE CIRCUIT
D1
D2
D3
M1
M2
M3
MOTOR
MOTOR
MOTOR
KK
IMAGE CARRIER
ROTATING POLYHEDRAL MIRROR
FEED ROLLER, ETC.
PR
Ra,Rr
FEEDING DIRECTION
SL2
A1y(A2y)
SL2K
SL1K
A1p (A2p)
SL1
SHa
S
SK
IIB
IIB
SN
Bp
By
A4, LONG SIDEWAYS
GP
C CONTROLLER
C1
SHEET SIZE DETECTING PART
SL1 AND SL2 REFERENCE POSITION MEMORY PART
SHEET VERTICAL SIZE DETECTING/MEMORY PART
SHEET HORIZONTAL SIZE DETECTING/MEMORY PART
C1a
C1b
C1c
C2
CORRECTED IMAGE MAGNIFICATION COMPUTING/MEMORY PART
VERTICAL MAGNIFICATION COMPUTING/MEMORY PART
HORIZONTAL MAGNIFICATION COMPUTING/MEMORY PART
C2a
C2b
C3
IMAGE RECORDING MEMBER CONTROL PART
IMAGE CARRIER ROTATION CONTROL PART
ROTATING POLYHEDRAL MIRROR ROTATION CONTROL PART
SHEET FEED CONTROL PART
POWER SUPPLY CIRCUIT CONTROL PART
C3a
C3b
C3c
C3d
FIG. 2B
SN
SNa
SNb
S
SL1
SL1a
SR
SL1b

IMAGE FORMATION DEVICE

BACKGROUND OF THE INVENTION

1. Field of the Invention

The present invention relates to an image formation device.

2. Description of the Related Art

An electrophotographic image formation device according to the prior art capable of operating in a double side image recording mode, a toner image is transferred to a second side of a sheet after another toner image transferred onto a first side of the sheet is fixed by heating. The sheet is dried as its moisture is evaporated by the image fixation by heat, and the drying shrinks the sheet.

Therefore, when images of the same size have been transferred on both sides of the sheet, the image on the first side becomes smaller than the image on the second side, because the latter is formed in a state in which the former formed on the first side of the sheet has shrunken.

In this case, relative to the original image, the magnification of the image formed on the first side of the sheet and that of the image formed on the second side become different.

The electrophotographic image formation device according to the prior art may be required to split one image into, for instance, two parts and, after recording the split parts of the image on a first side each of two sheets, to stick together the two sheets. In this case, borderlines to mark pasting margins or cut lines to mark margins to be removed may be recorded (or printed) in advance on both sides of the two sheets, and such lines can be aligned when the two sheets are stuck together. In this process, the sheet size may be different between the step of recording (or printing) a partial image on the first side of the sheet and the step of recording (or printing) border lines of the pasting margins (another image) on the second side of the sheet, because the sheet may have shrunken by the second step. In this case, the image on the first side of the sheet and the image (border lines of the pasting margins) on the second side may be misaligned, resulting in an inconsistent image on the first side when the two sheets are put together.

Especially in an electrophotographic image formation device in which sheets on each of which a toner image is transferred and fixed by heating, the sheet before recording on a first side may be relatively expanded by the moisture it contains, but this moisture would evaporate and dry up when the toner image formed on the first side is fixed by heating, and the sheet would shrink, making it liable for the split images to be misaligned more.

A number of techniques to equalize the magnifications of images to be formed on first and second images of a sheet are already known.

For instance, the known techniques include those disclosed in the following references.

(1) Technique described in Patent Reference 1 (Japanese Published Unexamined Patent Application No. 2002-72771)

According to the technique described in this Patent Reference 1, a sheet before and after image fixation by heating is manually set on a platen glass, and the sheet size is measured by a document reader before and after the image fixation by heating. The shrinking rate of the sheet is figured out from the resultant measurements, and the magnification of the image to be formed on the second side is adjusted on that basis.

(2) Technique described in Patent Reference 2 (Japanese Published Unexamined Patent Application No. Hei 4-288560)

According to the technique described in this Patent Reference 2, the vertical and horizontal dimensions of a copying sheet are detected by an optical sensor in a position immediately upstream from the copying position on the sheet-carrying route, and are then detected again by a similar sensor in a position immediately downstream from a thermal fixing device. The vertical dimension of the copying sheet is controlled by figuring out the vertical shrinking rate of the copying sheet from the length of time the copying sheet takes to pass the optical sensors 33 and 35, and switching over the operating speed of the optical system on the basis of the shrinking rate that has been figured out.

(3) Technique described in Patent Reference 3 (Japanese Published Unexamined Patent Application No. Hei 10-149057)

According to the technique described in this Patent Reference 3, the vertical shrinking rate of a first copying sheet is figured out by detecting the vertical dimensions of the first copying sheet before and after fixation from the length of time the copying sheet takes to pass an optical sensor arranged immediately upstream from the toner image transferring position on the sheet carrying route, and control is effected by and switching over the operating speed of the optical system for second and subsequent sheets on the basis of the shrinking rate of the first copying sheet.

[Patent Reference 1] Japanese Published Unexamined Patent Application No. 2002-72771 (lines 11 to 14, paragraph 15 of the pertinent Gazette)

[Patent Reference 2] Japanese Published Unexamined Patent Application No. Hei 4-288560 (paragraphs [0028] and [0030] of the pertinent Gazette)

[Patent Reference 3] Japanese Published Unexamined Patent Application No. Hei 10-149057 (paragraph [0018] of the pertinent Gazette)

(Problem with technique described in Patent Reference 1 (Japanese Published Unexamined Patent Application No. 2002-72771))

The technique described in Patent Reference 1 involves a problem of the extra trouble taken to measure the sheet size because the sheet has to be manually set on the platen glass 22 before and after the image fixation by heating. (Problem with technique described in Patent Reference 2 (Japanese Published Unexamined Patent Application No. Hei 4-288560))

According to the technique described in Patent Reference 2, because the two different optical sensors 33 and 35 are used for detecting the copying sheet size before and after the image fixation by heating, the errors of individual optical sensors in detecting the copying sheet size are added, resulting in a problem that the accuracy of copying sheet size detection deteriorates. Moreover, as the vertical dimension of the copying sheet is detected according to the length time the sheet takes to pass the optical sensors 33 and 35, if the carrying speed of the copying sheet varies, the accuracy of copying sheet size detection will also deteriorate.

(Problem with Technique Described in Patent Reference 3 (Japanese Published Unexamined Patent Application No. Hei 10-149057))

The technique described in Patent Reference 3 involves a problem that a variation in sheet carrying speed would result in a variation in the detected sheet size.

SUMMARY OF THE INVENTION

In view of the circumstances described above, the present invention is intended to meet the following elements (001) and (O02) stated below regarding an image formation device.

(O01) Errors of size detection of a sheet on which an image is to be recorded should be reduced.

(O02) The size of a sheet, held in a planar shape on a sheet size-detecting path, should be detected in a short period of time with high accuracy.

In describing the invention devised to solve the problems stated above, each element of the invention will be followed by a parenthesized sign, which denotes the corresponding element in any of the embodiments of the invention to be described afterwards, to facilitate understanding what counterparts the elements in this summary respectively have in the embodiments. The reason for using the reference signs in the description of the embodiments of the invention is merely to facilitate understanding of the invention and not to limit its scope to the embodiments described herein.

An image formation device according to the invention is provided with:

an upstream side sheet carrying path along which sheets are carried to an image recording position;

a downstream side sheet carrying path along which sheets having passed the image recording position are carried to an eject tray;

a sheet-returning path on which a one side recorded sheet, on a first side of which an image has been recorded, is inverted, and along which the inverted one side recorded sheet is returned to the upstream side sheet carrying path;

a sheet size detector which, positioned on the upstream side sheet-carrying path, detects a size of the sheet before image recording and a size of the inverted one side recorded sheet;

a image correction magnification computing/memory part which computes and stores an image magnification (b/a), where a a is the pre-recording sheet size detected by the sheet size detector and b is the size of the one side recorded sheet size, the image magnification (b/a) being the ratio to the image recorded on the unrecorded sheet at which recording is to be done on the second side of the one side recorded sheet according to a and b; and a control part which controls image recording onto the second side of the one side recorded sheet according to the computed image magnification.

In order to solve the problems, another image formation device according to the invention is provided with the following constituent elements:

a paper feed member (Rs) which separates on a one-by-one basis sheets (S) taken out of a paper feed tray (TR1) by a take-out roller (Rp) and feeds the separates sheets downstream in a sheet carrying direction;

an upstream side sheet carrying path (SH1) along which sheets (S) separated by the paper feed member (Rs) are carried to an image recording position (Q);

an image recording member (G) which records an image on a surface of a sheet passing the image recording position (Q) according to image recording member drive data;

a downstream side sheet carrying path (SH2) which carries recorded sheets, which are sheets (S) having undergone image recording, are carried to an eject tray (TRh);

a sheet returning path (SH4) which has a sheet inverting path (SH3) on which one side recorded sheets (S), on only a first side of which image recording has been done, are inverted and along which inverted one side recorded sheets are returned to the upstream side sheet carrying path (SH1);

the upstream side sheet carrying path (SH1) which has a sheet size detecting path (SHa) along which unrecorded sheets (S) separated by the paper feed member (Rs) and not yet having undergone image recording and the inverted one side recorded sheets are carried;

a sheet size detecting part (C1) which detects sheet sizes according to detection signals from sheet size detecting members (SK) for detecting the sizes of sheets (S) carried along the sheet size-detecting path (SHa);

a image correction magnification computing/memory part (C2) which computes and stores an image magnification (b/a), where a is the unrecorded sheet size detected by the sheet size detecting part (C1) and b is the size of the one side recorded sheet size, the image magnification (b/a) being the ratio to the image recorded on the unrecorded sheet at which recording is to be done on the second side of the one side recorded sheet according to a and b; and an image recording member control part (C3) which, according to the computed image magnification, supplies an operation control signal for the image-recording member (G) at the time of recording an image onto the second side of the one side recorded sheets (S).

In the image formation device according to the invention provided with the constituent elements, the paper feed member (Rs) separates on a one-by-one basis sheets (S) taken out of the paper feed tray (TR1) by the take-out roller (Rp) and feeds the separates sheets downstream in the sheet carrying direction. The sheets (S) separated by the paper feed member (Rs) are carried along the upstream side sheet-carrying path (SH1) the image recording position (Q). The image recording member (G) records according to image recording member drive data an image on the surface of a sheet passing the image recording position (Q). The recorded sheets, which are sheets (S) on which an image is already recorded, are carried along the downstream side sheet carrying path (SH2) to the eject tray (TRh). Along the sheet returning path (SH4), which has the sheet inverting path (SH3) for inverting one side recorded sheets, which are sheets (S) of each of which only a first side has undergone image recording, the inverted one side recorded sheets are returned to the upstream side sheet carrying path (SH1). The sheet size detecting members (SK) are arranged on the upstream side sheet carrying path (SH1) along which unrecorded sheets (S) separated by the paper feed member (Rs) and not yet having undergone image recording and the inverted one side recorded sheets are carried, and detect the sizes of the sheets (S) carried along the upstream side sheet carrying path (SH1).

The sheet size detecting part (C1) detects sheet sizes according to detection signals from the sheet size-detecting members. The image correction magnification computing/memory part (C2) computes and stores an image magnification (b/a), where a is the unrecorded sheet size detected by the sheet size detecting part (C1) and b is the size of the one side recorded sheet size, the image magnification (b/a) being the ratio to the image recorded on the unrecorded sheet at which recording is to be done on the second side of the one side recorded sheet according to a and b. The image recording member control part (C3) supplies, according to the computed image magnification, an operation control signal for the image recording member at the time of recording an image onto the second side of the one side recorded sheets.

Where the sizes of both sides of a sheet are to be measured by the same sensors (SL1, SL2 and SN), errors in sheet size detection can be reduced to make it possible to enhance the accuracy of correcting discrepancies in the images recorded on the two sides of the sheet. Moreover, the number of required sensors for sheet size detection can be reduced, resulting in a cost saving.

The image formation device according to the invention can also be provided with the following constituent elements:

sheet carrying members (Ra) which carry sheets (S) while holding them in a planar shape along the upstream side sheet carrying path (SH1) on which the sheet size detecting members (SK) are arranged; and sheet size detecting members (SK) which detect a sheet length in a carrying direction of sheets (S) held in the planar shape or a sheet width, which is a dimension of the sheets in a sheet width direction, on the upstream side sheet-carrying path (SH1) where the sheet size detecting members (SK) are arranged.

In the image formation device according to the invention provided with the constituent elements, the sheet carrying members (Ra) carry sheets while holding them in a planar shape along the upstream side sheet-carrying path (SH1) on which the sheet size detecting members (SK) are arranged. The sheet size detecting members (SK) detect the sheet length in the carrying direction of sheets held in a planar shape or the sheet width, which is the dimension of the sheets in the sheet width direction, on the upstream side sheet-carrying path (SH1).

The image formation device can be provided with the following constituent element:

sheet size detecting members (SK) which have a sheet end passage detector (SN) for detecting passage of one end of a sheet (S) in the carrying direction, the sheet being held in the planar shape, on the upstream side sheet carrying path (SH1) on which the sheet size detecting members (SK) are arranged and an other sheet end passage detector (SL1) for detecting the other end position of the sheet (S) when the sheet end passage detector (SN) has detected the passage of that one sheet end.

In the image formation device according to the invention provided with the constituent element, the sheet size detecting members (SK) have a sheet end passage detector (SN) and an other sheet end passage detector (SL1). The sheet end passage detector (SN) detects the passage of one end of a sheet (S) in the carrying direction, the sheet being held in the planar shape, on the upstream side sheet-carrying path (SH1) on which the sheet size detecting members (SK) are arranged. The other sheet end passage detector (SL1) detects another end position of the sheet when the sheet end passage detector (SN) has detected the passage of the one sheet end.

The image formation device according to the invention can be provided with the following constituent element:

plural sheet end passage detectors (SN1, SN2, SN3 and SN4) arranged according to the sheet size.

In the image formation device provided with the constituent element, plural sheet end passage detectors (SN1, SN2, SN3 and SN4) are arranged according to the sheet size.

The image formation device according to the invention can be provided with the following constituent element:

an upstream side sheet direct carrying path (SH1) which directly supplies sheets (S) separated by a paper feed member (Rs) to the image recording position (Q) instead of feeding them by way of the upstream side sheet carrying path (SH1) on which the sheet size detecting members (SK) are arranged.

In the image formation device provided with the constituent elements, sheets (S) separated by the paper feed member (Rs) are directly supplied along the upstream side sheet direct carrying path (SH1) to the image recording position (Q) instead of going by way of the upstream side sheet carrying path (SH1) on which the sheet size detecting members (SK) are arranged.

The image formation device according to the invention can be provided with the following constituent elements:

the paper feed tray (TR1) which is configured to be able also to feed sheets in a direct paper feeding direction which is reverse to a regular feeding direction of the sheets taken out by the take-out roller (Rp);

a direct paper feed member (Rs) which separates on a one-by-one basis the sheets (S) fed in the direct paper feeding direction and feeds them downstream in a sheet carrying direction; and an upstream side sheet direct carrying path (SH1) along which are directly supplied sheets (S) separated by the direct paper feed member (Rs) to the image recording position (Q) instead of being fed by way of the upstream side sheet carrying path (SH1) on which the sheet size detecting members (SK) are arranged.

In the image formation device provided with the constituent elements, the paper feed tray (TR1) can also feed sheets (S) in the direct paper feeding direction which is reverse to the regular feeding direction of the sheets taken out by the take-out roller (Rp). The direct paper feed member (Rs) separates on a one-by-one basis the sheets (S) fed in the direct paper feeding direction and feeds them downstream in the sheet carrying direction. Along the upstream side sheet direct carrying path (SH1) are directly supplied sheets (S) separated by the direct paper feed member (Rs) to the image recording position (Q) instead of being fed by way of the upstream side sheet carrying path (SH1) on which the sheet size detecting members (SK) are arranged.

The image formation device according to the invention can be provided with the following constituent element:

the take-out roller (Rp) which takes out sheets (S) accommodated in the paper feed tray (TR1) and can feed them in either the regular feeding direction or the direct paper feeding direction which is reverse thereto.

In the image formation device provided with the constituent element, the take-out roller (Rp) takes out sheets (S) accommodated in the paper feed tray (TR1) and can feed them in either the regular feeding direction or the direct paper feeding direction which is reverse thereto.

The image formation device according to the invention can be provided with the following constituent elements:

a second paper feed tray (TR2) which, apart from the paper feed tray (TR1) in which sheets (S) to be carried to the image recording position (Q) via the upstream side sheet carrying path (SH1) on which the sheet size detecting members (SK) are arranged are accommodated, accommodates sheets (S) to be directly supplied to the image recording position (Q) instead of going by way of the upstream side sheet carrying path (SH1) on which the sheet size detecting members (SK) are arranged;

a take-out roller (Rp) which can take out sheets (S) accommodated in the second paper feed tray (TR2) and carry them in a paper feeding direction;

a second paper feed member (Rs) which separates on a one-by-one basis sheets (S) taken out of the second paper feed tray (TR2) and feeds them downstream in the sheet carrying direction; and a second upstream side sheet carrying path (SH5) along which sheets (S) separated by the second paper feed member (Rs) are directly supplied to the image recording position (Q) instead of going by way of the upstream side sheet carrying path (SH1) on which the sheet size detecting members (SK) are arranged.

In the image formation device provided with the constituent elements, sheets (S) accommodated in a second paper feed tray (TR2), apart from the paper feed tray (TR1) in which sheets (S) to be carried to the image recording position (Q) via the upstream side sheet carrying path (SH1) on which the sheet size detecting members (SK) are arranged are accommodated, are directly supplied to the image recording position (Q) instead of going by way of the upstream side sheet carrying path (SH1) on which the sheet size detecting members (SK) are arranged. The take-out roller (Rp) can take out sheets accommodated in the second paper feed tray (TR2) and carry them in the paper feeding direction. The second paper feed member (Rs) separates on a one-by-one basis sheets (S) taken out of the second paper feed tray (TR2) and feeds them downstream in the sheet carrying direction. Along the second upstream side sheet carrying path (SH5), sheets (S) separated by the second paper feed member (Rs) are directly supplied to the image recording position (Q) instead of going by way of the upstream side sheet carrying path (SH1) on which the sheet size detecting members (SK) are arranged.

The image formation device according to the invention can be provided with the following constituent elements:

the paper feed tray (TR1) and the second paper feed tray (TR2) in each of which sheets (S) of the same size are accommodated; and a replenishing paper feed path (SH6) along which sheets (S) are supplied from one of the paper feed tray (TR1) and the second paper feed tray (TR2) to the other.

In the image formation device provided with the constituent elements, sheets (S) of the same size are accommodated in the paper feed tray (TR1) and the second paper feed tray (TR2). Along the replenishing paper feed path (SH6), sheets (S) are supplied from one of the paper feed tray (TR1) and the second paper feed tray (TR2) to the other.

The image formation device according to the invention can be provided with the following constituent elements:

the paper feed tray (TR1) and the second paper feed tray (TR2) which are arranged adjacent to each other; and the paper feed tray (TR1) and the second paper feed tray (TR2) between which sheets (S) are directly supplied from one to the other instead of going by way of any sheet carrying path.

In the image formation device provided with the constituent elements, the paper feed tray (TR1) and second paper feed tray (TR2) are arranged adjacent to each other. Between the paper feed tray (TR1) and the second paper feed tray (TR2), sheets (S) are directly supplied from one to the other instead of going by way of any sheet carrying path. A sheet replenishing device supplies sheets (S) directly from one to the other of the paper feed tray (TR1) and the second paper feed tray (TR2) instead of going by way of any sheet carrying path.

The image formation device according to the invention can be provided with the following constituent elements:

a paper feed member (Rs) which separates on a one-by-one basis sheets (S) taken out of the paper feed tray (TR1) by the take-out roller (Rp) and feeds them downstream in a sheet carrying direction;

an upstream side sheet carrying path (SH1) along which sheets (S) separated by the paper feed member (Rs) are carried to the image recording position (Q);

an image recording member (G) which records on a surface of a sheet passing the image recording position (Q) according to image recording member drive data;

a downstream side sheet carrying path (SH2) along which recorded sheets, which are sheets (S) having undergone image recording, are carried to an eject tray (TRh);

a sheet returning path (SH4) which has a sheet inverting path (SH3) on which one side recorded sheets (S), on only a first side of which image recording has been done, are inverted and along which inverted one side recorded sheets are returned to the upstream side sheet carrying path (SH1);

an image scanner which is arranged on the upstream side sheet carrying path (SH1) along which unrecorded sheets before recording of any image, separated by the paper feed member (Rs) and the inverted one side recorded sheets are carried, and reads images on surfaces of sheets carried along the upstream side sheet carrying path (SH1) and sheet sizes;

a sheet size detecting part (C1) which detects a sheet size according to a sheet size detecting signal from the image scanner;

a image correction magnification computing/memory part (C2) which, where a represents the unrecorded sheet size detected by the image scanner and b represents the one side recorded sheet size, computes an image magnification of recording on a second side of the one side recorded sheet relative to the image recorded on the unrecorded sheet according to a and b, and stores the computed image magnification; and an image recording member control part (C3) which supplies an operation control signal for the image recording member (G) at the time of image recording onto the second side of the one side recorded sheet (S) according to the computed image magnification.

In the image formation device provided with the constituent elements, the paper feed member (Rs) separates on a one-by-one basis sheets (S) taken out of the paper feed tray (TR1) by the take-out roller (Rp) and feeds them downstream in the sheet carrying direction. The sheets separated by the paper feed member (Rs) are carried along the upstream side sheet carrying path (SH1) to the image recording position (Q). The image recording member (G) records on the surface of a sheet passing the image recording position (Q) according to image recording member drive data. Recorded sheets, which are sheets (S) having undergone image recording, are carried along the downstream side sheet carrying path (SH2) to the eject tray (TRh). The sheet returning path (SH4) has the sheet inverting path (SH3) on which one side recorded sheets, on only the first side of which image recording has been done, are inverted, and the inverted one side recorded sheets are returned to the upstream side sheet carrying path (SH1) along the sheet returning path (SH4).

The image scanner, arranged on the upstream side sheet carrying path (SH1) along which unrecorded sheets before recording of any image, separated by the paper feed member (Rs) and the inverted one side recorded sheets are carried, reads the image on and the size of the sheet carried along the upstream side sheet carrying path (SH1). The sheet size detecting part (C1) detects the sheet size according to a sheet size detecting signal from the image scanner. The image correction magnification computing/memory part (C2), where a represents the unrecorded sheet size detected by the image scanner and b represents the one side recorded sheet size, computes the image magnification of recording on the second side of the one side recorded sheet relative to the image recorded on the unrecorded sheet according to a and b, and stores the computed image magnification. The image recording member control part (C3) supplies an operation control signal for the image recording member (G) at the time of image recording onto the second side of the one side recorded sheet (S) according to the computed image magnification.

Where the sizes of both sides of a sheet are to be measured by the same sensors, errors in sheet size detection can be reduced to make it possible to enhance the accuracy of correcting discrepancies in the images recorded on the two sides of the sheet. Moreover, the number of required sensors for sheet size detection can be reduced, resulting in cost saving.

BRIEF DESCRIPTION OF THE DRAWINGS

The above-stated and other features and advantages of the present invention will become more apparent from the following detailed description when taken in conjunction with the accompanying drawings, wherein:

FIGS. 2A and 2B illustrate a sheet size detecting path and sheet size detecting members in the image formation device, which is Embodiment 1 of the invention: FIG. 2A being a block diagram showing the arrangement of sheet size detecting members as such and a controller therefor, and FIG. 2B being a section along line IIB—IIB in FIG. 2A;

FIG. 8A showing the configuration of sheet size detecting members, and FIG. 8B showing a sheet size detecting method;

FIG. 20A showing the arrangement of sheet size detecting members on a sheet size detecting path, and FIG. 20B showing a view of the arrangement seen from XXB in FIG. 20A;

DETAILED DESCRIPTION OF THE PREFERRED EMBODIMENTS

Next will be described preferred embodiments of the present invention, but it has to be noted that the invention is not limited to these embodiments.

Embodiment 1

Figure 1:
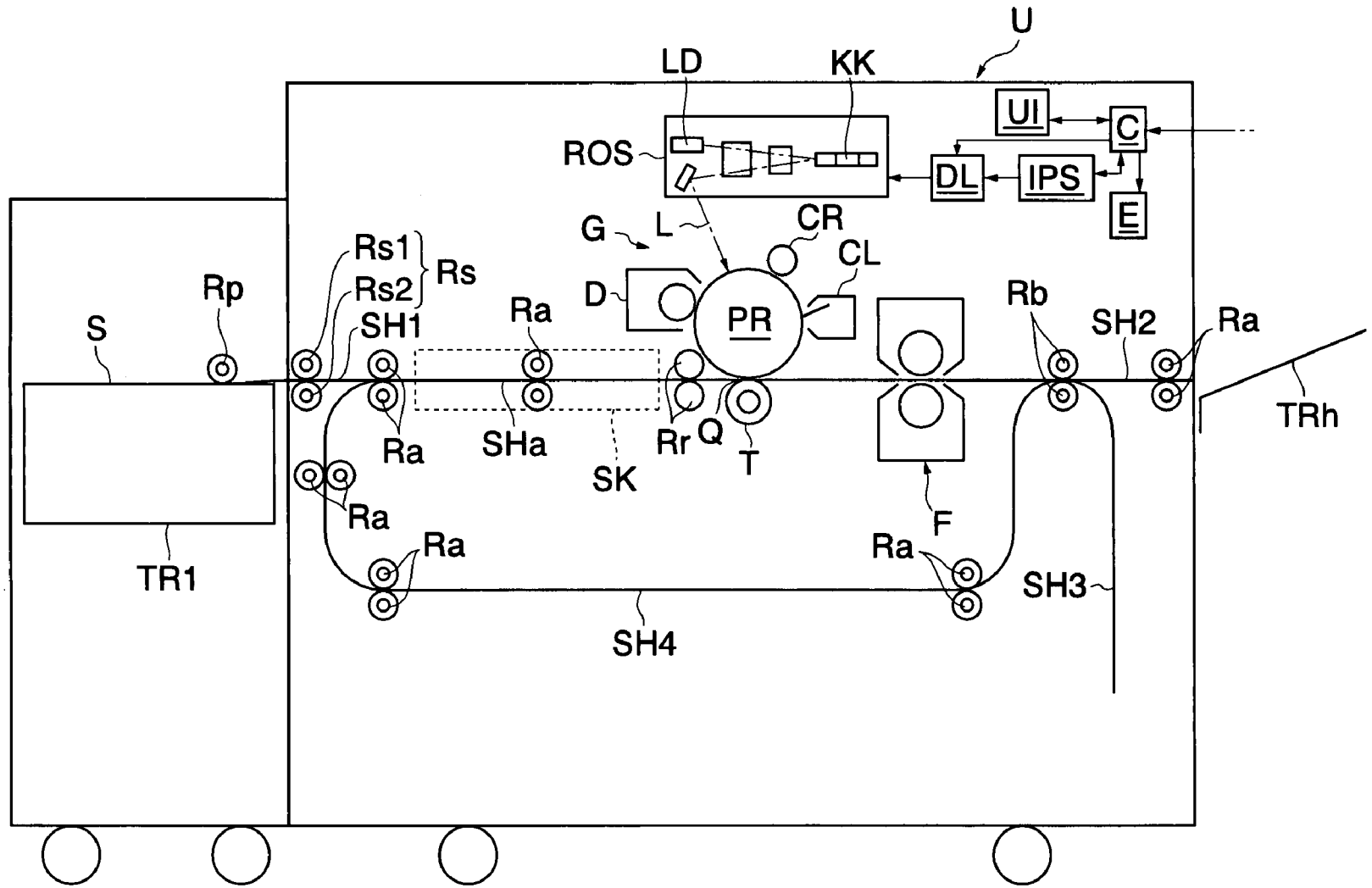
FIG. 1 shows a vertical section of an image formation device which is Embodiment 1 of the present invention.

FIG. 1 shows a vertical section of an image formation device which is a first preferred embodiment of the present invention.

Referring to FIG. 1, an image formation device (printer) U has a user interface (UI) and an image processing system (IPS).

Data for image recording entered from a computer (not shown) into a controller C of the image formation device (printer) U is stored into a memory for temporary storage of the IPS. The IPS converts the data for image recording entered from the controller C into bit map image data, and supplies it to a laser drive circuit DL as laser drive data. The laser drive circuit DL supplies a laser drive signal corresponding to the entered laser drive data to the laser diode (LD) of an ROS (optical write scanning device or image writing device).

The surface of the image carrier (photosensitive drum) PR of the image formation device U is uniformly electrified by an electrifying roller CR, and an electrostatic latent image is written onto the surface with a laser beam L emitted from the ROS (latent image writing device). The electrostatic latent image is developed into a toner image by a developing device D. The toner image shifts to an transfer area Q opposite a transfer roller T along with the rotation of the image carrier PR.

A power supply circuits E controlled by the controller C applies to the transfer roller T a transfer voltage reverse in polarity to the electrification polarity of the developing toner.

Between the paper feed tray TR1 and the transfer area (image recording position) Q, there is arranged an upstream side sheet carrying path SH1. The upstream side sheet carrying path SH1 is a path along which a sheet S taken out of the paper feed tray TR1 is carried to the transfer area Q by plural feed rollers Ra, and midway on the upstream side sheet carrying path SH1 is set a sheet size detecting path SHa for carrying the sheet S in a state of being held in a planar shape. On the sheet size detecting path SHa, the sheet S is carried by the feed rollers (sheet carrying members) Ra in a state of being held in a planar shape. Adjacent to the paper feed tray TR1 are arranged paper feed members Rs, and adjacent to the transfer area Q are arranged resistration rollers Rr.

The sheets S accommodated in the tray TR1 are taken out by a pickup roller Rp at a prescribed timing, and fed to the upstream side sheet carrying path SH1. The fed sheets S are separated one by one by paper feed members Rs including a paper feed roller Rs1 and a separating roller (separating member) Rs2, being pressed against each other, and carried the plural feed rollers Ra to the sheet size detecting path SHa.

The sheet size detecting path SHa is provided with a sheet size detecting member SK for detecting the size of the sheets S. When recording is to be done on both sides of each of the sheets S, the sheet size detecting member SK supplies a sheet size detecting signal for the sheets S passing the sheet size detecting path SHa. The sheets S having passed the sheet size detecting path SHa, after being stopped temporarily by the resistration rollers Rr, are carried to the transfer area Q at a prescribed timing. When each of the sheets S passes the transfer area Q, a toner image on the image carrier PR is transferred onto the sheet S by the transfer roller T.

Residual toner on the surface of the image carrier PR, left over after the transfer is removed by a cleaner CL.

An image recording member G for recording images on the sheets S is provided with the image carrier PR, electrifying roller CR, latent image writing device ROS, transfer roller T, cleaner CL and so forth.

Between the transfer area Q and a sheet eject tray TRh is arranged a downstream side sheet carrying path SH2, and the downstream side sheet carrying path SH2 is provided with a fixing device F. The sheet S, onto which a toner image was transferred in the transfer area undergoes fixation of the toner image when it passes the fixing device F. In a single side recoding job, the single side recorded sheet S on which a toner image is on only one side is discharged to the sheet eject tray TRh.

Downstream from the fixing device F of the downstream side sheet carrying path SH2 are provided forward/backward rotating feed rollers Rb. To the downstream side sheet carrying path SH2 are connected a sheet inverting path SH3 downstream from the forward/backward rotating feed rollers Rb and a sheet returning path SH4 upstream from the same.

In a double side recoding job, the single side recorded sheet S is carried toward the sheet inverting path SH3 by the forward rotations of the forward/backward rotating feed rollers Rb of the downstream side sheet carrying path SH2 and, immediately before the rear end of the sheet passes the forward/backward rotating feed rollers Rb, the forward/backward rotating feed rollers Rb are reversed to switch back the single side recorded sheet S to carry it in the reverse direction. Then the single side recorded sheet S is inverted carried to the sheet returning path SH4.

The single side recorded sheet S, carried to the sheet returning path SH4 after being inverted on the sheet inverting path SH3, is returned to the sheet size detecting path SHa. In this case, the recorded side of the single side recorded sheet S is the back side. The sheet S before recording on the second side, returned to the sheet size detecting path SHa, undergoes detection of the sheet size before second side recording by the sheet size detecting member SK.

An unrecorded sheet size detected when an unrecorded sheet (before recording on a first side) passes the sheet size detecting path SHa being represented by a and a one side recorded sheet size (sheet size before recording on a second side) detected when the one side recorded sheet S (after recording on the first side) passes the sheet size detecting path SHa being represented by b, a>b usually holds because the one side recorded sheet is dried when the image on it is fixed. Thus, the image recorded on one side is shrunken by b/a compared with what it was when transferred to the sheet. Therefore, in order to equalize the image magnifications on the two sides of the sheet S, the image magnification on the image carrier surface for image formation on the second side of the sheet S should be (b/a) times the image magnification on the image carrier surface for image formation on the first side of the sheet S.

For this reason, the image to be recorded on the second side of the one side recorded sheet is corrected by adjusting the rotating speed of the image carrier PR and that of a rotating polyhedral mirror KK provided in the ROS according to the image magnification. Thus, the rotating speed of the image carrier PR at the time of image formation on the second side is reduced to b/a of the rotating speed o at the time of image formation on the first side, and the rotating speed of the rotating polyhedral mirror KK is increased to a/b of the same. This process will be described in detail afterwards with reference to FIGS. 2A and 2B.

An image whose magnification has been corrected is recorded on to the second side of the single side recorded sheet S carried to the transfer area Q. The two side recorded sheet S is carried along the downstream side sheet carrying path SH2 and discharged to the sheet eject tray TRh.

FIGS. 2A and 2B illustrate the controller of the sheet size detecting device in Embodiment 1 of the invention: FIG. 2A showing sheet size detecting members and block lines, and FIG. 2B, a section along line IIB—IIB in FIG. 2A.

Referring to FIGS. 2A and 2B, at the rear end of the sheet size detecting path SHa which is provided midway on the upstream side sheet carrying path SH1 and along which the sheet S is carried in a state of being held in a planar shape, there is arranged a sheet guide GP in parallel to the sheet carrying direction, and the rear end of the sheet carried along the sheet size detecting path SHa is guided thereby. The sheet size detecting path SHa is further provided with the sheet size detecting member SK. The sheet size detecting member SK has a vertical direction (feeding direction) sensor SL1 for detecting the front end of the sheet that is carried a horizontal direction (width wise direction) sensor SL2 and a photosensor SN.

Referring to FIG. 2B, the photosensor SN has a light emitting unit SNa which radiates light and a light receiving unit SNb which receives light. The photosensor SN detects the front end of the sheet S by a drop in the quantity light received by the light receiving unit SNb.

On the upstream side of the photosensor SN in the sheet carrying direction, there is provided the vertical direction sensor SL1. The vertical direction sensor SL1 has a light source SL1*a*, a Selfoc SR and a line sensor SL1*b*. The line sensor SL1*b* is provided with a large number of light receiving elements (linear CCDs) arranged on a straight line, and the position of each light receiving element is determined by the reference position SLLK (the downstream end of the vertical direction sensor SL1) of the vertical direction sensor SL1. The vertical direction sensor SL1 detects the position of the upstream side end of the sheet S in the vertical direction (the position of the rear end of the sheet) at the time of detection of the front end of the sheet S by the photosensor SN.

The horizontal direction sensor SL2 is arranged at another end of the sheet S than that guided by the sheet guide GP. The horizontal direction sensor SL2 is similarly configured as the vertical direction sensor SL1 is, and detects the position of an end of the sheet S in the horizontal direction when the sheet S is guided by the sheet guide GP.

Description of the Controller in Embodiment 1

Referring to FIGS. 2A and 2B, the controller C is provided with an (input/output interface (I/O) (not shown) for controlling the inputting/outputting of signals from and to outside and the level of input/output signals, a read only memory (ROM) for in which stores programs and data for necessary processing, a random access memory (RAM) for temporarily storing necessary data, a central processing unit (CPU) for carrying out processing according to any of the programs stored in the ROM, and a computer having a clock oscillator and other elements. Various functions can be implemented by executing programs stored in the ROM.

(Signal Input Elements Connected to the Controller C)

Signals from the user interface (UI), the vertical direction sensor SL1, the horizontal direction sensor SL2, the photosensor SN and other signal input elements are entered into the controller C.

The the UI is provided with an indicator, a tray selection key, a mode selection key and the like.

(Controlled Elements Connected to the Controller C)

The controller C is connected to the IPS, an image carrier rotation drive circuit D1, a rotating polyhedral mirror rotation drive circuit D2, a sheet feeding member drive circuit D3, the power supply circuits E and other controlled elements, and supplies operation control signals for them.

The image carrier rotation drive circuit D1 rotationally drives the image carrier PR via an image carrier drive motor M1.

The rotating polyhedral mirror rotation drive circuit D2 rotationally drives the rotating polyhedral mirror KK via a rotating polyhedral mirror-drive motor M2.

The sheet feeding member drive circuit D3 drives sheet-carrying members (including the feed rollers Ra and the resistration rollers Rr) via a sheet carrying member drive motor M3.

The power supply circuits E have a development biasing power supply circuit for applying a bias to the developing roller of the developing device D, an electrifying power supply circuit for applying an electrifying voltage to an electrifying roller charge roller (CR), an LD drive power supply circuit, a transferring power supply circuit, a fixing power supply circuit and so forth.

(Functions of the Controller C)

The controller C has the following control elements C1 through C3, and each of the control elements C1 through C3 has a function to execute processing according to an input signal from a signal output element and supplying control signals to controlled elements.

C1: Sheet Size Detecting Part

A sheet size detecting part C1, having an SL1 and SL2 reference position memory part C1*a*, a sheet vertical size detecting/memory part C1*b* and a sheet horizontal size detecting/memory part C1*c*, supplies sheet size detecting signals.

C1*a*: SL1 and SL2 Reference Position Memory Part

The SL1 and SL2 reference position memory part C1*a* stores the distance Bp from the position of the photosensor SN where the front end of the sheet S is detected to the position (the reference position of sensor SL1) of the downstream end SLLK of the vertical direction sensor SL1 (see FIGS. 2A and 2B) (the vertical direction reference distance) and the distance By from the sheet guide face of the sheet guide GP to the position (the reference position of sensor SL2) of the sheet guide GP side end SL2K of the horizontal direction sensor SL2 (the horizontal direction reference distance).

C1*b*: Sheet Vertical Size (Sheet Length) Detecting/Memory Part

The sheet vertical size detecting/memory part C1*b* detects the sum of adding the distance A1*p* (first side measurement) or A2*p* (second side measurement) from the position of the vertical direction upstream side end (rear end) of the sheet S to the reference position SL1K of the sensor SL1 and the vertical direction reference distance Bp. In-other words, the vertical length (A1*p*+Bp) of the sheet S when an image is to be recorded on the first side of the sheet S and the vertical length (A2*p*+Bp) of the sheet S when an image is to be recorded on the second side of the sheet S are detected, and the vertical lengths of the sheet S (A1*p*+Bp) and (A2*p*+Bp) are stored.

C1*c*: Sheet Horizontal Size (Sheet Width) Detecting/Memory Part

The sheet horizontal size detecting/memory part C1*c* detects the sum of adding the distance A1*y* (first side measurement) or the distance A2*y* (second side measurement) from the position of a horizontal direction end of the sheet S to the reference position SL2K of sensor SL2 and the By. Thus it detects the horizontal length of the sheet S when an image is to be recorded on the first side of the sheet S (A1*y*+By) and the horizontal length of the sheet S when an image is to be recorded on the second side of the sheet S (A2*y*+By), and stores the horizontal lengths (A1*y*+By) and (A2*y*+By) of the sheet S.

C2: Image Correction Magnification Computing/Memory Part

The image magnification computing part C2, having a vertical magnification computing/memory part C2*a* and a horizontal magnification computing/memory part C2*b*, computes image magnifications.

C2*a*: Vertical Magnification Computing/Memory Part

The vertical magnification computing/memory part C2*a* computes the vertical direction image magnification (A2*p*+Bp)/(A1*p*+Bp) of the image to be recorded on the second side of the sheet S on the basis of the vertical lengths (A1*p*+Bp) and (A2*p*+Bp) of the sheet S before image recording on the first side and before recording on the second side stored in the sheet vertical size (sheet length) detecting/memory part C1*b*, and stores the computed magnification.

C2*b*: Horizontal Magnification Computing/Memory Part

The horizontal magnification computing/memory part C2*b* computes the horizontal direction image magnification (A2*y*+Bp)/(A1*y*+Bp) of the image to be recorded on the second side of the sheet S on the basis of the horizontal lengths (A1*y*+By) and (A2*y*+By) of the sheet S before image recording on the first side and before recording on the second side stored in the sheet horizontal size (sheet width) detecting/memory part C1*c*, and stores the computed magnification.

C3: Image Recording Member Control Part

The image recording member control part C3, having an image carrier rotation control part C3*a*, a rotating polyhedral mirror rotation control part C3*b*, a sheet feed control part C3*c* and a power supply circuit control part C3*d*, controls the rotations of image recording members.

C3*a*: Image Carrier Rotation Control Part

The image carrier rotation control part C3*a* controls the rotation of the image carrier PR on the basis of the vertical direction image magnification (A2*p*+Bp)/(A1*p*+Bp) computed by the vertical magnification computing part C2*a*. Thus, it so controls the rotation that the rotating speed of the image carrier PR in image formation on the second side be (A2P+Bp)/(A1*p*+BP) of that in image formation on the first side.

C3*b*: Rotating Polyhedral Mirror Rotation Control Part

The rotating polyhedral mirror rotation control part C3*b* controls the rotation of the rotating polyhedral mirror KK on the basis of the horizontal image magnification (A2*y*+Bp)/(A1*y*+Bp) computed by the horizontal magnification computing part C2*b*. Where contraction takes place compared with image formation on the first side (i.e. the image magnification is smaller than 1), the rotating speed of the rotating polyhedral mirror KK should be faster than at the time of image formation on the first side. Thus, rotation control is so performed that the rotating speed of the rotating polyhedral mirror KK in image formation on the second side is (A1*y*+By)/(A2*y*+By) times that in image formation on the first side (reciprocal of the image magnification).

C3*c*: Sheet Feed Control Part

The sheet feed control part C3*c* controls the timing of sheets S by the paper feed tray TR1, the sheet carrying speed and so forth.

C3*d*: Power Supply Circuit Control Part

The power supply circuit control part C3*d* controls the operations of the development biasing power supply circuit, the electrifying power supply circuit, the LD drive power supply circuit, the transferring power supply circuit, the fixing power supply circuit and so forth.

Explanation of Flowcharts of Embodiment 1

Figure 3:
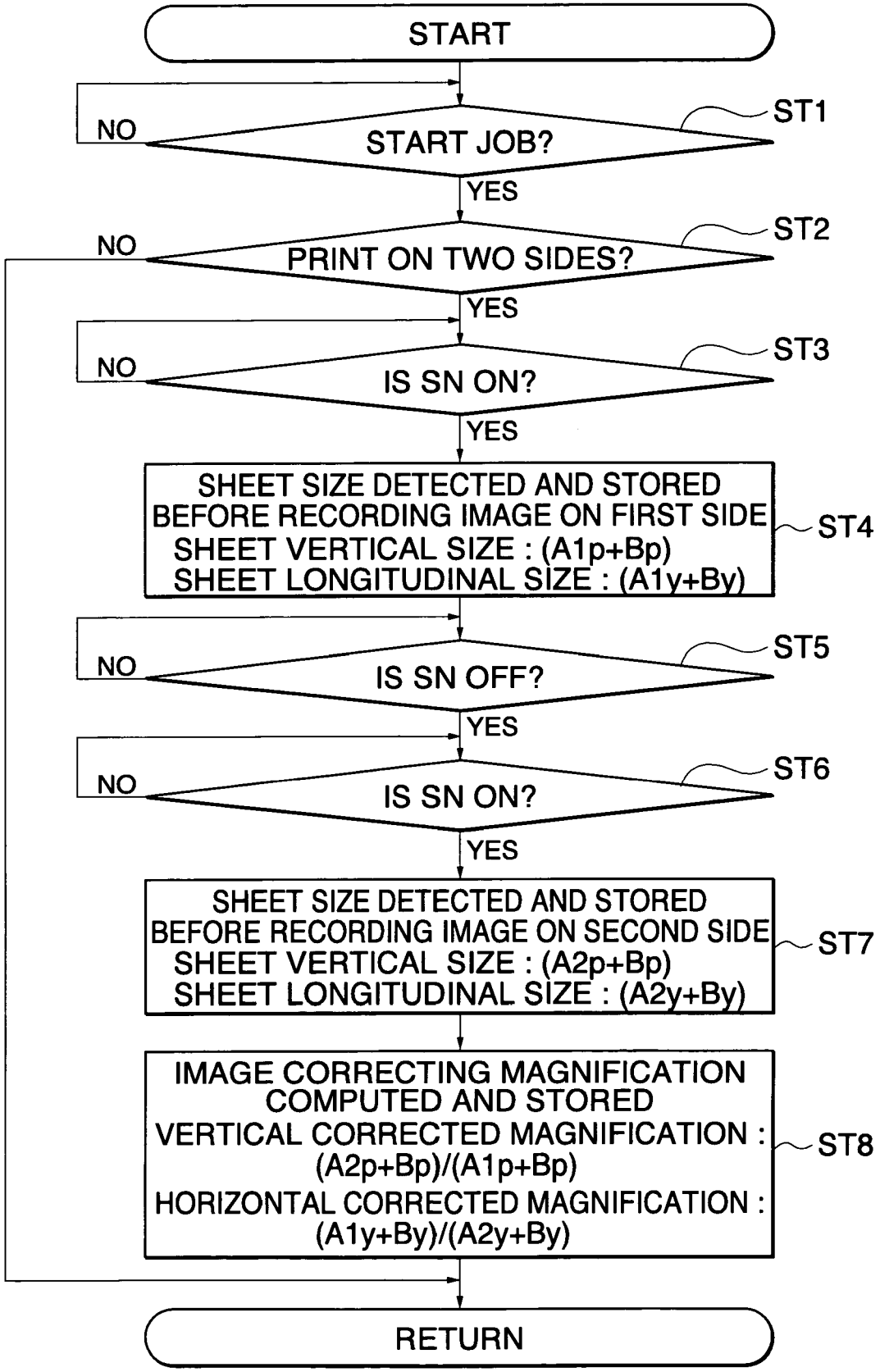
FIG. 3 is a flowchart of magnification setting for the image to be formed on the second side of double side printing in the image formation device, which is Embodiment 1 of the invention.

FIG. 3 is a flowchart of magnification setting for the image to be formed on the second side of double side printing in the image formation device, which is Embodiment 1 of the invention.

Processing of each step (ST) in FIG. 3 is carried out in accordance with a program stored in the ROM of the controller C. This sequence of processing is also executed on a multi-task basis in parallel with other processing sequences of the image formation device.

Referring to FIG. 3, when magnification setting for the image to be formed on the second side of double side printing is started, it is determined at step (ST) 1 whether or not a job has been started. If the answer is N (No), ST1 will be repeated or, if it is Y (Yes), the processing will go ahead to ST2.

At ST2, it is determined whether or not printing is to be done on both sides. If the answer is N (No) the processing will return to ST1 or, if it is Y (Yes), go ahead to ST3.

At ST3, it is determined whether not the photosensor SN has detected the front end (downstream side end) of the sheet S. If the answer is N (No), ST3 will be repeated or, if it is Y (Yes), go ahead to ST4.

At ST4, the sheet size before image recording on the first side of the sheet is detected and stored. Thus, the vertical sheet dimension (A1*p*+Bp) and the horizontal sheet dimension (A1*y*+By) are measured, and the measurements are stored. Then the processing goes ahead to ST5.

At ST5, it is determined whether or not the photosensor SN has been turned off. In other words, it is determined whether or not the rear end of the sheet S before image recording has passed.

If the answer is N (No), ST5 will be repeated or, if it is Y (Yes), go ahead to ST6.

At ST6, it is determined whether or not the photosensor SN has detected the front end of the sheet S. If the answer is N (No), ST6 will be repeated or, if it is Y (Yes), go ahead to ST7.

At ST7, the sheet size before image recording on the second side of the sheet is detected and stored. Thus, the vertical sheet dimension (A2*p*+Bp) and the horizontal sheet dimension (A2*y*+By) are measured, and the measurements are stored. Then the processing goes ahead to ST8.

At ST8, magnification setting for the image to be formed on the second side of the sheet is computed and stored. In other words, the vertical corrected magnification (A2*p*+Bp)/(A1*p*+Bp) and the reciprocal of the horizontal corrected magnification (A1*y*+By)/(A2*y*+By) are computed and stored. The processing then returns to ST1.

Figure 4:
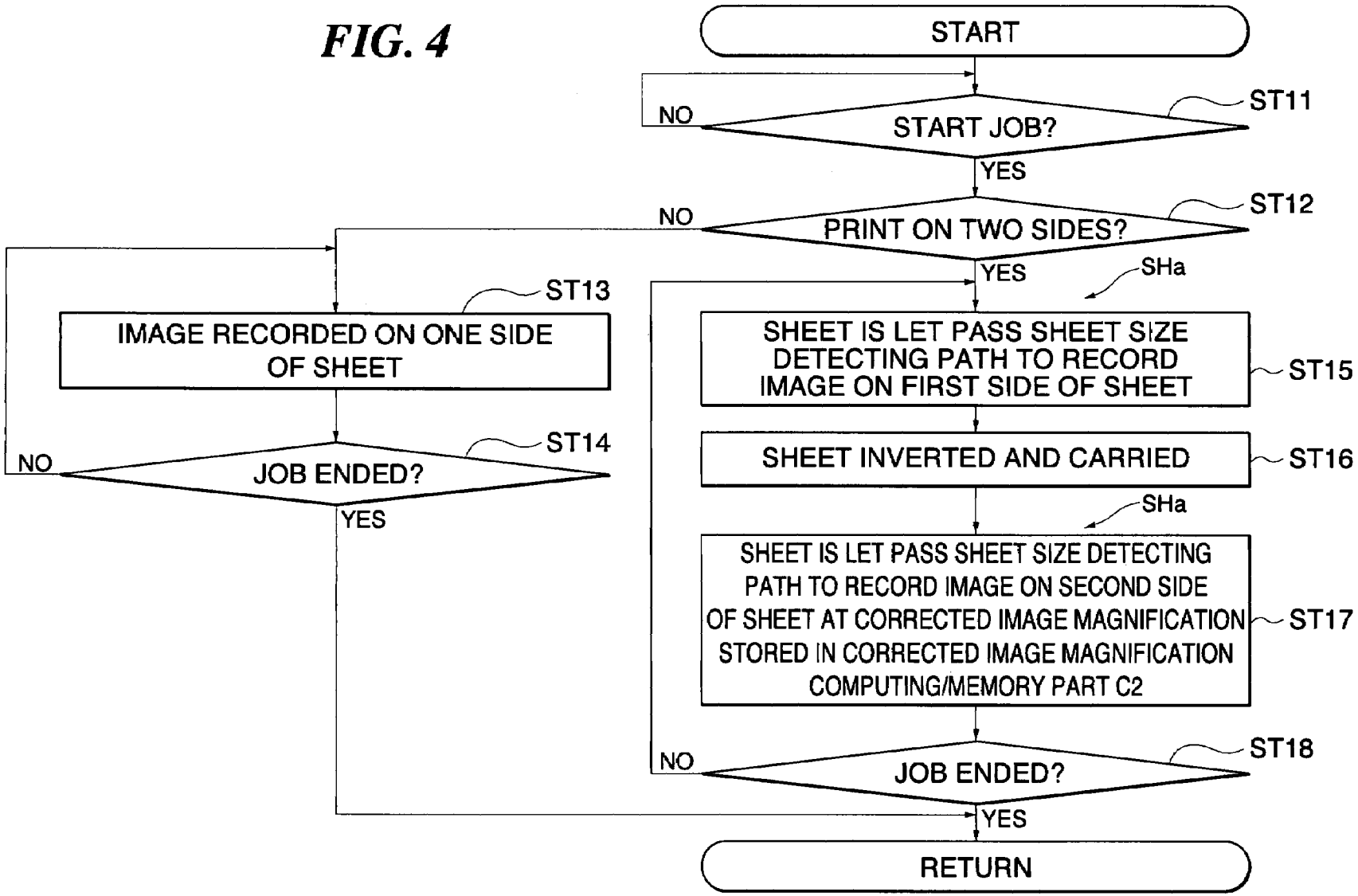
FIG. 4 is a flowchart of image recording in the image formation device, which is Embodiment 1 of the invention.

FIG. 4 is a flowchart of image recording in the image formation device, which is Embodiment 1 of the invention.

Referring to FIG. 4, when image recording is started, at ST11 it is determined whether or not a job has been started. If the answer is N (No), ST11 will be repeated or, if it is Y (Yes), go ahead to ST12.

At ST12, it is determined whether or printing is to be done on both sides. If the answer is N (No), the processing will go ahead to ST13 or, if Y (Yes), to ST15.

At ST13, an image is recorded on one side of the sheet. Then the processing will go ahead to ST14.

At ST14, it is determined whether or not the job has been ended. If the answer is N (No), the processing will return to ST13 or if Y (Yes), to ST11.

At ST15, an image is recorded on the first side of the sheet having been let pass the sheet size detecting path SHa. Then the processing will go ahead to ST16.

At ST16, the sheet is inverted and returned to the sheet size detecting path SHa. Then the processing will go ahead to ST17.

At ST17, an image is recorded on the second side of the inverted sheet having been let pass the sheet size detecting path at the image correction magnification stored in the image correction magnification computing/memory part C2 (the image correction magnification computed and stored at ST8 in FIG. 3). Then the processing will go ahead to ST18.

At ST18, it is determined whether or not the job has been ended. If the answer is N (No), the processing will return to ST15, or if Y (Yes), to ST11.

Actions of Embodiment 1

In the image formation device having the configuration described above, which is Embodiment 1 of the invention, when a job of double side printing has been started, the size of the first one of the sheets S to be carried to the sheet size detecting path SHa is detected and stored. An image of the usual magnification (100% magnification) is formed (transferred and fixed) on the first side of the first sheet S. Recording on one side of the first sheet S will have been completed then, and this first sheet will be inverted by the plural feed rollers Ra and the reversible forward/backward rotating feed rollers Rb arranged on the sheet inverting path SH3 and the sheet returning path SH4, and returned to the sheet size detecting path SHa. The size of the first sheet S before recording is done on its second side is detected by the sheet size detecting member SK, and stored. On the basis of the sheet size stored before recording on the first side and the sheet size stored before recording on the second side, the reciprocals of the vertical corrected magnification (A2$p$+Bp)/(A1$p$+Bp) and of the horizontal corrected magnification (A1$y$+By)/(A2$y$+By) of the image to be recorded on the first sheet S are computed and stored. On the basis of the image correction magnifications, image writing (latent image formation) by the ROS is started while rotating the rotating polyhedral mirror KK and the image carrier PR. Timed with the development of the electrostatic latent image formed by the ROS on the image carrier PR into a toner image and its shift to the transfer area Q, the first sheet S is carried by the resistration rollers Rr to the transfer area Q at a prescribed timing. In the transfer area Q, an image corrected with the vertical corrected magnification (A2$p$+Bp)/(A1$p$+Bp) and the reciprocal of the horizontal corrected magnification (A1$y$+By)/(A2$y$+By) is transferred onto the second side of the first sheet S, and fixed by the fixing device F.

The image correction magnification for the second sides of the second and subsequent sheets of the job can be acquired by either of the following methods (1) and (2).

(1) As the corrected magnification for the second and subsequent sheets of the job, the image correction magnification for the first sheet of the job is used.

(2) The sheet sizes of everyone of the second and subsequent sheets of the job before recording on the first side and before recording on the second side are detected, and the image correction magnification for the second side is computed on a sheet-by-sheet basis.

In this Embodiment 1, Method (1) is used, while Method (2) is used in Embodiment 2 to be described afterwards.

Thus in this first embodiment, if a job of double side printing is started, an image will be formed on the first side of each of the second and subsequent sheets S in the usual magnification (100%), and an image corrected with the vertical corrected magnification (A2$p$+Bp)/(A1$p$+Bp) and the reciprocal of the horizontal corrected magnification (A1$y$+By)/(A2$y$+By) computed for the first sheet is recorded on the second side. Thus, as the image correction magnification for the image to be recorded on the second side each of the second and subsequent sheets S, the first image correction magnification is used from the start until the end of the job. As the size of the second or any subsequent sheet S is not detected for this reason, the period of time during which the sheet S is kept at halt in the position of the resistration rollers Rr at the time of image formation on the second side each of the second and subsequent sheets S is eliminated, the job on the second or any subsequent sheet S can be accomplished more quickly than that on the first.

Compared with the conventional method by which the vertical size of a sheet is detected according to the length of time taken by the sheet to pass the sheet size sensors, this Embodiment 1 detects the vertical size of the sheet instantaneously with the vertical direction (carrying direction) sensor SL1 and the photosensor SN, and accordingly the detection of the vertical size of the sheet is unaffected by any slip or speed variation during the carriage of the sheet. This makes it possible to detect the sheet size very accurately. Moreover, as the sheet size can be detected without having to stop the sheet on its carrying path, the sheet size can be detected at higher speed.

In this Embodiment 1, since the size detection for the first and second sides of the sheet can accomplished by the same sensors, the detection error of the sheet size is reduced. By contrast, size detection for the first and second sides of the sheet is performed by different sensors, unevenness between the different sensors will magnify the detector error of the sheet size. Next will be explained the reason why the accuracy of computing the magnification is higher when the sheet size before recoding an image on the first side and that before recording an image on the second side are measured by the same sensors than when they are measured by different sensors.

The causes for errors in sheet size measurement by different sensors include errors ΔS1 and ΔS2 in fitting positions at the time of fitting or due to temperature variations or degradation over time and repeat errors (errors caused per measurement) e1 and e2 of the sensors themselves. Shown below are measurement errors of sheet elongation ΔL when different sensors are used for two sides of the sheet and when the same sensors are used, where L1 is the measured sheet size (vertical or horizontal) of the front side (first side); L2, the measured sheet size (vertical or horizontal)of the rear side (second side), and L, the real sheet dimension. The real value of sheet elongation is represented by ΔL0.

(A) Where different sensors are used for measuring the size of two sides of the sheet:

$$\text{Before transfer: } L1=L+\Delta S1+e1$$

$$\text{After transfer: } L2=L+\Delta L0+\Delta S2+e2$$

$$\text{Measured sheet elongation } \Delta L=L2-L1=\Delta L0+\Delta S2+e2-(\Delta S1+e1)$$

$$\text{Hence, measured sheet elongation } \Delta L=\text{measurement error of } L2-L1=\text{sqrt}\left((\Delta S1)^2+(\Delta S2)^2+(e1)^2+(e2)^2\right) \quad (1)$$

(B) Where the same sensors are used for measuring the size of two sides of the sheet:

$$\text{Before transfer: } L1=L+\Delta S1+e1$$

$$\text{After transfer: } L2=L+\Delta L0+\Delta S1+e2$$

$$\text{Measured sheet elongation } \Delta L=L2-L1=\Delta L0+e2-e1$$

$$\text{Hence, measured sheet elongation } \Delta L=\text{measurement error of } L2-L1=\text{sqrt}\left((e1)^2+(e2)^2\right) \quad (2)$$

From Equations (1) and (2), it is seen that the error in the measured sheet elongation ΔL is smaller when measured by the same sensors. The reason is that, where the same sensors are used, the effects of errors in fitting position can be cancelled among one another.

The image magnification, which is the ratio of the sheet size L1+ΔL before recording on the second size to the sheet size L1 before recording on the first side is (L1+ΔL)/L1=1+ΔL/L1; the smaller the error of ΔL is, the higher the accuracy of computing the magnification is. Thus, the accuracy of computing the magnification is higher in (B) where the sheet size before recording an image on the first side and that before recording an image on the second side are measured by the same sensors than in (A) where they are measured by different sensors.

Embodiment 2

Figure 5:
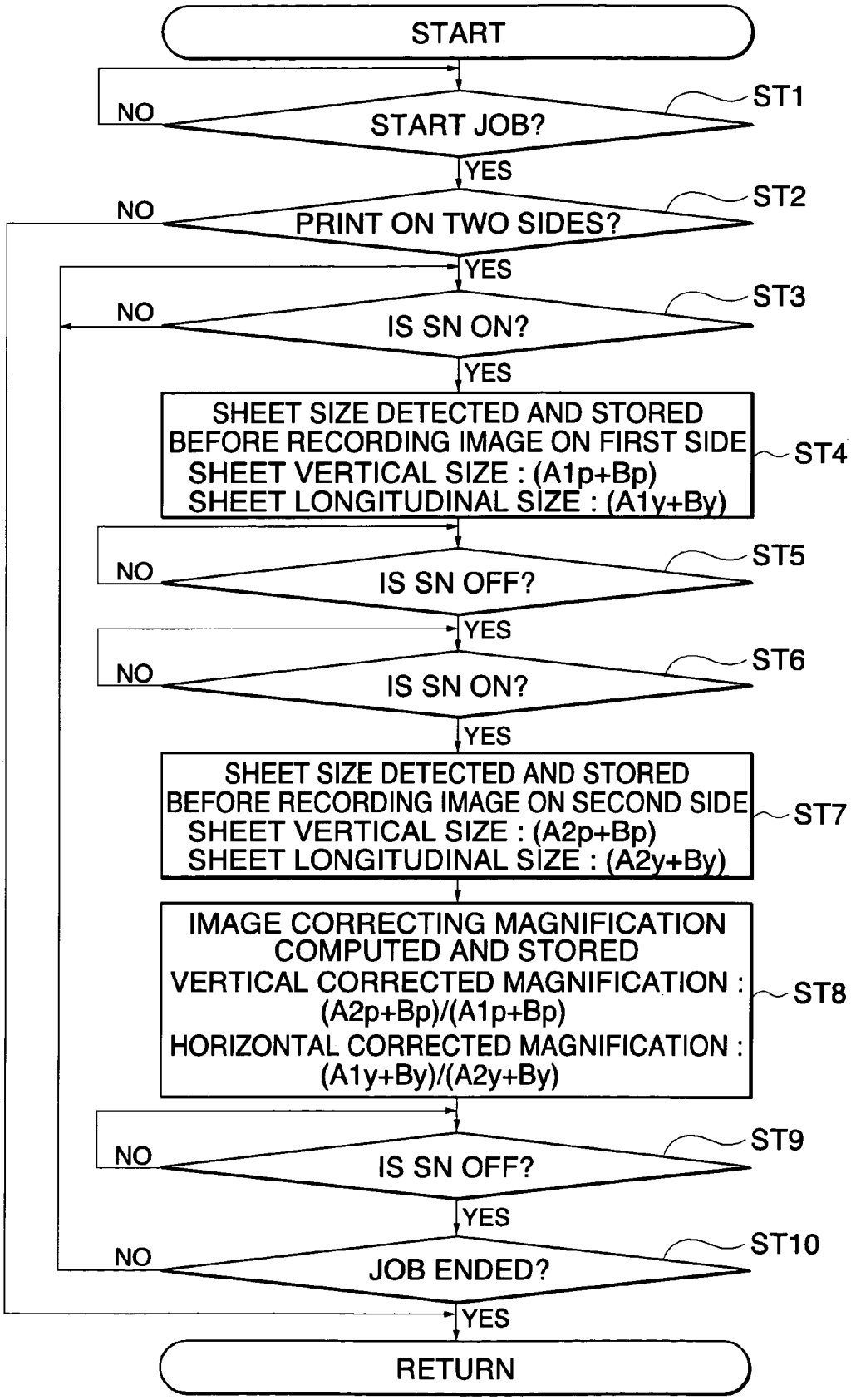
FIG. 5 is a flowchart of magnification setting for the image to be formed on the second side of double side printing in an image formation device, which is Embodiment 2 of the invention corresponding to FIG. 3 for Embodiment 1.

FIG. 5 is a flowchart of magnification setting for the image to be formed on the second side of double side printing in an image formation device, which is Embodiment 2 of the invention, and is a counter part to FIG. 3 for Embodiment 1.

In the description of the image formation device of FIG. 5, which is Embodiment 2 of the invention, constituent elements having counterparts in the image formation device of Embodiment 1 will be denoted by respectively the same signs and their detailed description will be dispensed with.

An overall of the image formation device of this Embodiment 2 is the same as that of Embodiment 1 (FIG. 1). The flowchart of image recording in Embodiment 2 is the same as FIG. 4 of Embodiment 1.

This Embodiment 2 uses Method (2) described with reference to the foregoing Embodiment 1. For this reason the flowchart of Embodiment 2 shown in FIG. 5 is a version of that of magnification setting for the image to be formed on the second side in two side printing in Embodiment 1 shown in FIG. 3, augmented with steps (ST) 9 and 10.

At ST9, it is determined whether or not the photosensor SN has been turned off. If the answer is N (No), ST9 will be repeated or, if it is Y (Yes), go ahead to ST10.

At ST10, it is determined whether or not the job has been ended. If the answer is N (No), the processing will return to ST3 or if Y (Yes), to ST1.

According to this flowchart of FIG. 5, in double side printing, if the answer is N (No) at ST10, the processing will return to ST3. For this reason, in double side printing, the size of every sheet before recording on the first side and that before recording on the second side are detected until the job is ended, and the corrected magnification of the image on the second side is computed and stored.

Actions of Embodiment 2

While the size of only the first sheet S is detected in Embodiment 1, the size of every sheet S on which an image is to be formed is detected from the start until the end of a job. Thus, the corrected magnification of the image to be recorded on the second side of the sheet S on which an image is to be formed is computed every time from the start until the end of a job. As a result, the image formed on the second side of each sheet S in Embodiment 2 is more accurate than that formed on the second side of any of the sheets S in Embodiment 1.

Since the sheet size before recording on the first side and that before recording on the second side are detected in this Embodiment 2 by the same sheet size detecting member SK as in Embodiment 1, the magnification of the image to be recorded on the second side of each sheet can be accurately corrected.

Embodiment 3

Figure 6:
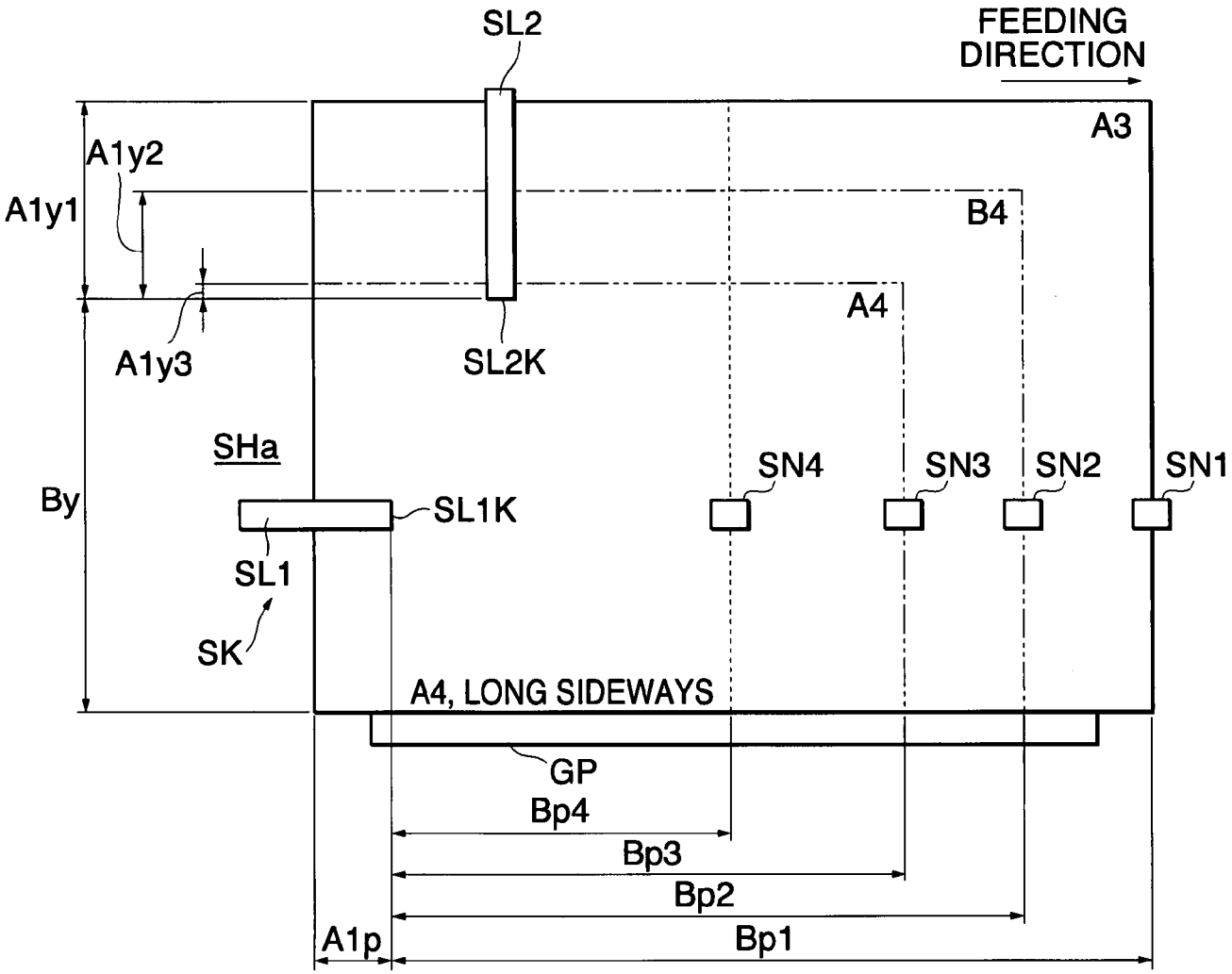
FIG. 6 illustrates the configuration of sheet size detecting members in an image formation device, which is Embodiment 3 of the invention.

FIG. 6 illustrates the configuration of sheet size detecting members in an image formation device, which is Embodiment 3 of the invention.

In the description of the image formation device of FIG. 6, which is Embodiment 3 of the invention, constituent elements having counterparts in the image formation device of Embodiment 1 will be denoted by respectively the same signs and their detailed description will be dispensed with.

In the image formation device of this Embodiment 3, the paper feed tray can accommodate sheets of any of the A3, B4 and A4 sizes and, though the configuration of its sheet size detecting member SK differs from that in Embodiment 1, this embodiment is the same as Embodiment 1 in all other aspects of configuration.

Although the sheet size detecting member SK of Embodiment 1 shown in FIGS. 2A and 2B has the vertical direction sensor SL1, the horizontal direction sensor SL2 and one photosensor SN, the sheet size detecting member SK of Embodiment 3 shown in FIG. 6 has the vertical direction sensor SL1, the horizontal direction sensor SL2 and four photosensors SN1 through SN4. Thus, while Embodiment 1 shown in FIGS. 2A and 2B has only one photosensor matching only one sheet size, i.e. A4, long sideways, Embodiment 3 shown in FIG. 6 has the four photosensors SN1 through SN4 to match sheets S of four different size types including A3, long sideways, B4, long sideways, A4, longitudinally long and A4, long sideways. The SL1 and SL2 reference position memory part C1*a* store distances Bp1 through Bp4 from the respective positions of the photosensors SN1 through SN4 to the reference position SL1K of the sensor SL1.

Actions of Embodiment 3

In Embodiment 3, the sheet dimensions in the vertical and horizontal directions are detected according to detection signals from the one vertical direction (carrying direction) sensor SL1 and the one horizontal direction sensor SL2 when any of the four photosensors SN1 through SN4 arranged to match sheets of the four different size types has detected the front end of a sheet. Thus, as the four different sheet size types can be detected, the magnification for the image to be formed on the second side of each sheet can be corrected according to the pertinent one of the four different sheet size types.

Since the sheet size before recording on the first side and that before recording on the second side are detected in this Embodiment 3 by the same sheet size detecting member SK as in Embodiment 1, the magnification of the image to be recorded on the second side of each sheet can be accurately corrected.

Embodiment 4

Figure 7:
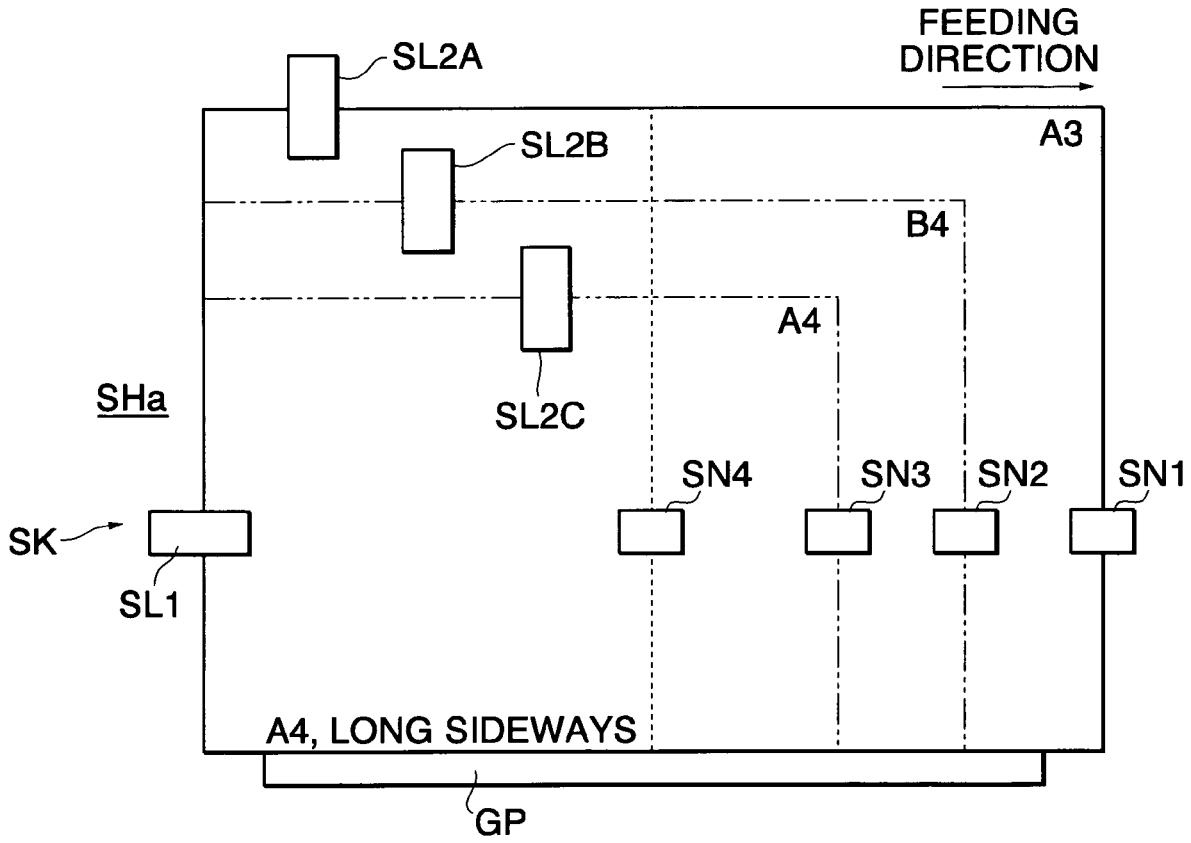
FIG. 7 illustrates the configuration of sheet size detecting members in an image formation device, which is Embodiment 4 of the invention.

FIG. 7 illustrates the configuration of sheet size detecting members in an image formation device, which is Embodiment 4 of the invention.

In the description of the image formation device of FIG. 7 which is Embodiment 4 of the invention, constituent elements having counterparts in the image formation device of Embodiment 1 will be denoted by respectively the same signs and their detailed description will be dispensed with.

In the image formation device of this Embodiment 4, the paper feed tray can accommodate sheets of any of the A3, B4 and A4 sizes and, though the configuration of its sheet size detecting member SK differs from that in Embodiment 1, this embodiment is the same as Embodiment 1 in all other aspects of configuration.

The sheet size detecting member SK of Embodiment 4 shown in FIG. 7 has the vertical direction sensor SL1, three horizontal direction sensors SL2A, SL2B and SL2C, and four photosensors SN1 through SN4. Thus, Embodiment 4 shown in FIG. 7 are provided with the three horizontal direction sensors SL2A, SL2B and SL2C and the four photosensors SN1 through SN4 to match sheets S of four different size types including A3, long sideways, B4, long sideways, A4, longitudinally long and A4, long sideways.

Actions of Embodiment 4

In Embodiment 4, the sheet dimensions in the vertical and horizontal directions are detected according to detection signals from one vertical direction (carrying direction) sensor SL1 and the three horizontal direction sensors SL2A, SL2B and SL2C when any of the four photosensors SN1 through SN4 arranged to match sheets of the four different size types has detected the front end of a sheet. Thus, as the image formation device of this Embodiment 4 can detect the four different sheet size types as in Embodiment 3, the magnification for the image to be formed on the second side of each sheet can be corrected according to the pertinent one of the four different sheet size types.

Embodiment 5

Figure 8A:
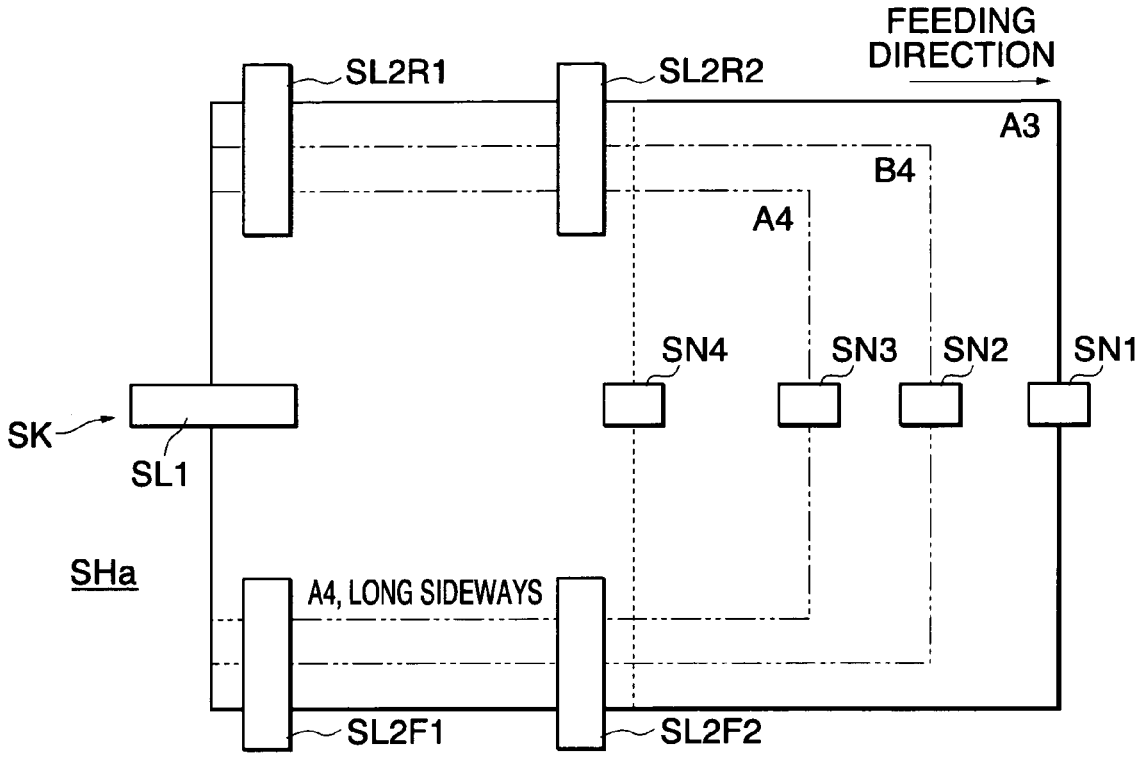
FIGS. 8A and 8B illustrate an image formation device, which is Embodiment 5 of the invention.
Figure 8B:
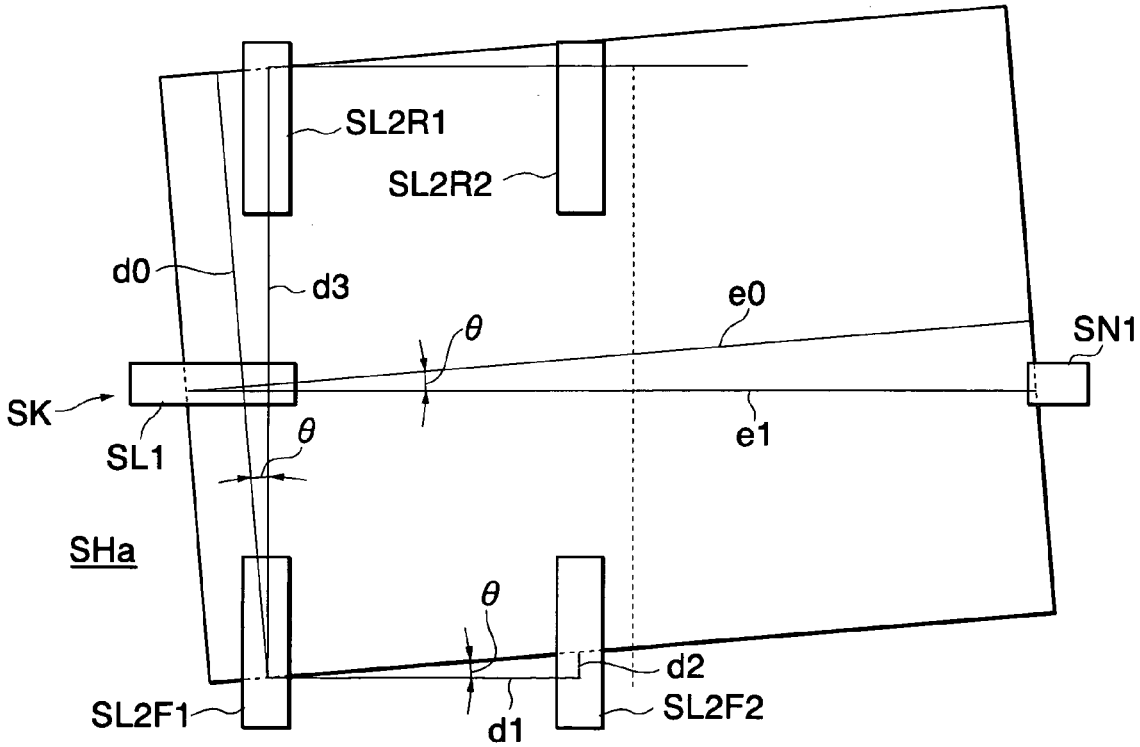

FIGS. 8A and 8B illustrate an image formation device, which is Embodiment 5 of the invention: FIG. 8A showing the configuration of sheet size detecting members, and FIG. 8B showing a sheet size detecting method.

In the description of the image formation device of FIGS. 8A and 8B, which is Embodiment 5 of the invention, constituent elements having counterparts in the image formation device of Embodiment 1 will be denoted by respectively the same signs and their detailed description will be dispensed with.

In the image formation device of this Embodiment 5, the paper feed tray can accommodate sheets of any of the A3, B4 and A4 sizes, and the configuration of its sheet size detecting member SK differs from that in Embodiment 1. Further, while the image formation device of Embodiment 1 shown in FIGS. 2A and 2B carries the sheets aligned on one side width wise (side-aligned), the image formation device of this Embodiment 5 carries the sheets aligned on aligned on the center line (centered).

And the sheet size detecting member SK of Embodiment 5 shown in FIGS. 8A and 8B has one vertical direction sensor SL1, a total of four horizontal direction sensors SL2F1, SL2F2, SL2R1 and SL2R2, two each being arranged on each side edge, to detect the side edges width wise of the sheets and four photosensors SN1 through SN4.

Actions of Embodiment 5

In Embodiment 5, the sheet dimensions in the vertical and horizontal directions are detected according to detection signals from one vertical direction (carrying direction) sensor SL1 and the total of four horizontal direction sensors SL2F1, SL2F2, SL2R1 and SL2R2, two each being arranged on each side edge width wise, when any of the four photosensors SN1 through SN4 arranged to match sheets of the four different size types has detected the front end of a sheet.

Referring to FIG. 8B, when a sheet is carried in an inclined state along the sheet size detecting path SHa, a distance d2 is detected from values detected by the pair of horizontal direction sensors SL2F1 and SL2F2, arranged at a distance d1 in the vertical direction. In this case, the angle θ of inclination of the sheet S is calculated from $\tan\theta = d2/d1$. Also, the width d3 of the sheet S in the inclined state is detected from values detected by the pair of horizontal direction sensors SL2F1 and SL2R1 arranged at a certain distance in the horizontal direction from each other. In this case, the real width d0 of the sheet S is calculated from $d0 = d3 \cos\theta$.

Further the length e1 of the sheet S in the inclined state in the vertical direction is detected from values detected by the photosensor SN1 and the vertical direction sensor SL1 arranged at a certain distance in the vertical direction from each other. In this case, the real length e0 of the sheet S in the vertical direction is calculated from $e0 = e1 \cos\theta$.

Therefore, since this Embodiment 5 can detect the four different sheet size types as in Embodiment 3, the magnification for the image to be formed on the second side of each sheet can be corrected according to the pertinent one of the four different sheet size types.

Embodiment 6

Figure 9:
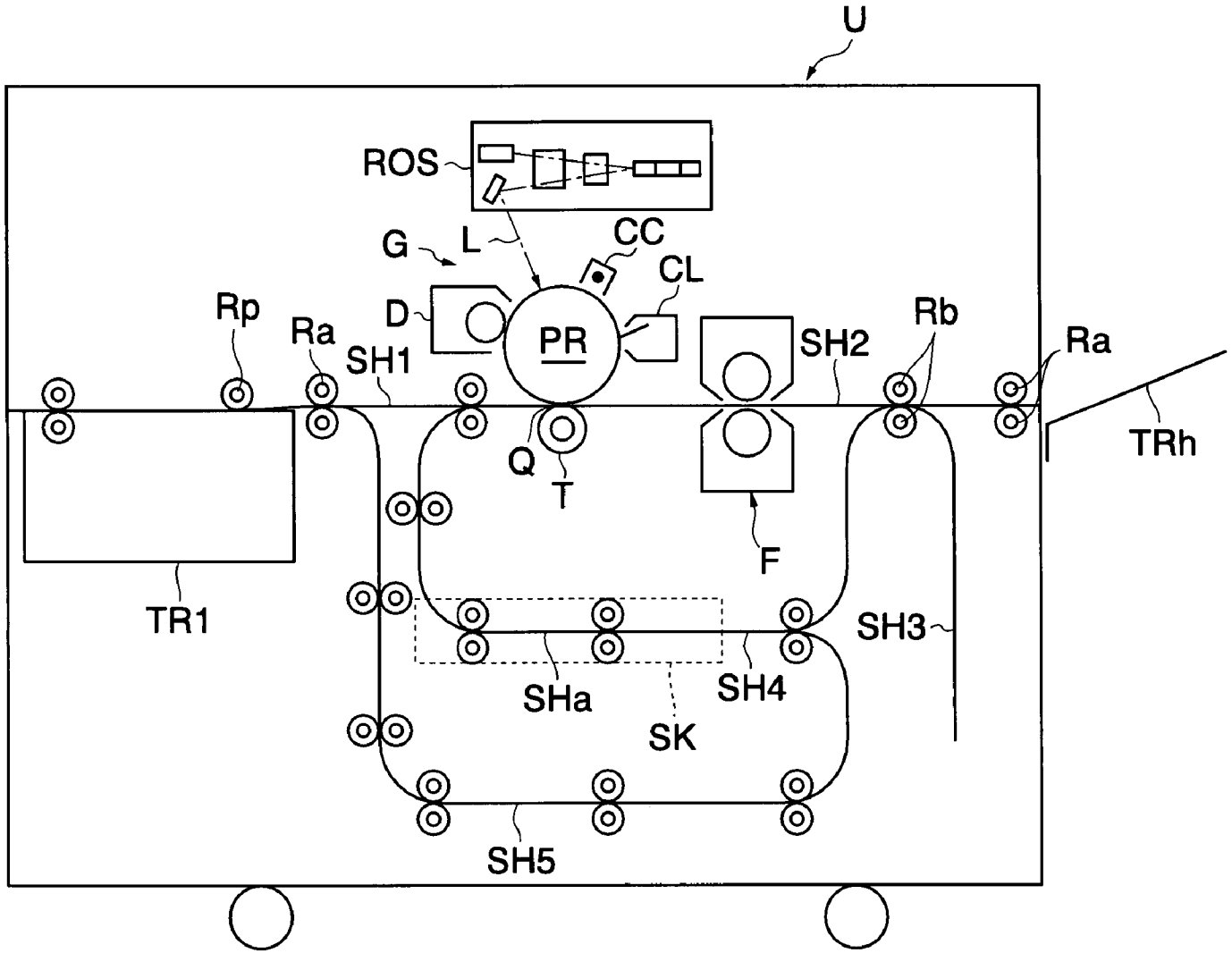
FIG. 9 illustrates an image formation device, which is Embodiment 6 of the invention.

FIG. 9 illustrates an image formation device, which is Embodiment 6 of the invention.

In the description of the image formation device of FIG. 9, which is Embodiment 6 of the invention, constituent elements having counterparts in the image formation device of Embodiment 1 will be denoted by respectively the same signs and their detailed description will be dispensed with.

In the image formation device of this Embodiment 6, the paper feed tray TR1 is arranged in the same case as the image recording member G is. Since, for this reason, the distance of the linear upstream side sheet carrying path SH1 from the paper feed tray TR1 to the transfer area (image recording position) Q is short, it is impossible to set the sheet size detecting path SHa on the upstream side sheet carrying path SH1. Accordingly, the sheet size detecting path SHa is set on the sheet returning path SH4. And, to enable the sheet size before recording on the first side to be detected, when recording on both sides, an upstream side sheet carrying path SH5 for double side recording to carry sheets from the paper feed tray TR1 is provided farther upstream from the sheet size detecting path SHa set on the sheet returning path SH4.

Actions of Embodiment 6

In this Embodiment 6, in performing a single side recording job, sheets are carried from the paper feed tray TR1 to the transfer area Q via the upstream side sheet carrying path SH1. However, in a double side recording job, the first sheet of the job is carried to the transfer area Q via the upstream side sheet carrying path SH5 for double side recording and the sheet size detecting path SHa. The size of this sheet before recording an image on one side is detected when it passes the sheet size detecting path SHa and, after recording is done on that one side, the sheet size before recording on the second side is detected when the sheet is inverted on the sheet inverting path SH3 and passes the sheet size detecting path SHa set on the sheet returning path SH4.

The image magnification on the second side of each of the second and subsequent sheets can be corrected by either of the following Methods (1) and (2).

(1) The second and subsequent sheets of the job are fed from the paper feed tray TR1 along the upstream side sheet carrying path SH1 which is shorter in distance to the transfer area (image recording position) Q. As the corrected magnification for the second and subsequent sheets of the job, the image correction magnification for the first sheet of the job is used.

(2) Each of the second and subsequent sheets of the job is fed from the upstream side sheet carrying path SH5 for double side recording and les pass the sheet size detecting path SHa. The sheet size before recording on the first side and that before recording on the second side of every sheet is detected, the image correction magnification for the second side of each sheet is computed, and an image of that image correction magnification so computed is formed on the second side.

Therefore, as the image formation device of this Embodiment 6, like Embodiment 1, detects the sheet size before recording on the first side and that before recording on the second side with the same sheet size detecting member SK, the magnification of the image to be formed on the second side of the sheet can be accurately corrected.

Embodiment 7

Figure 10:
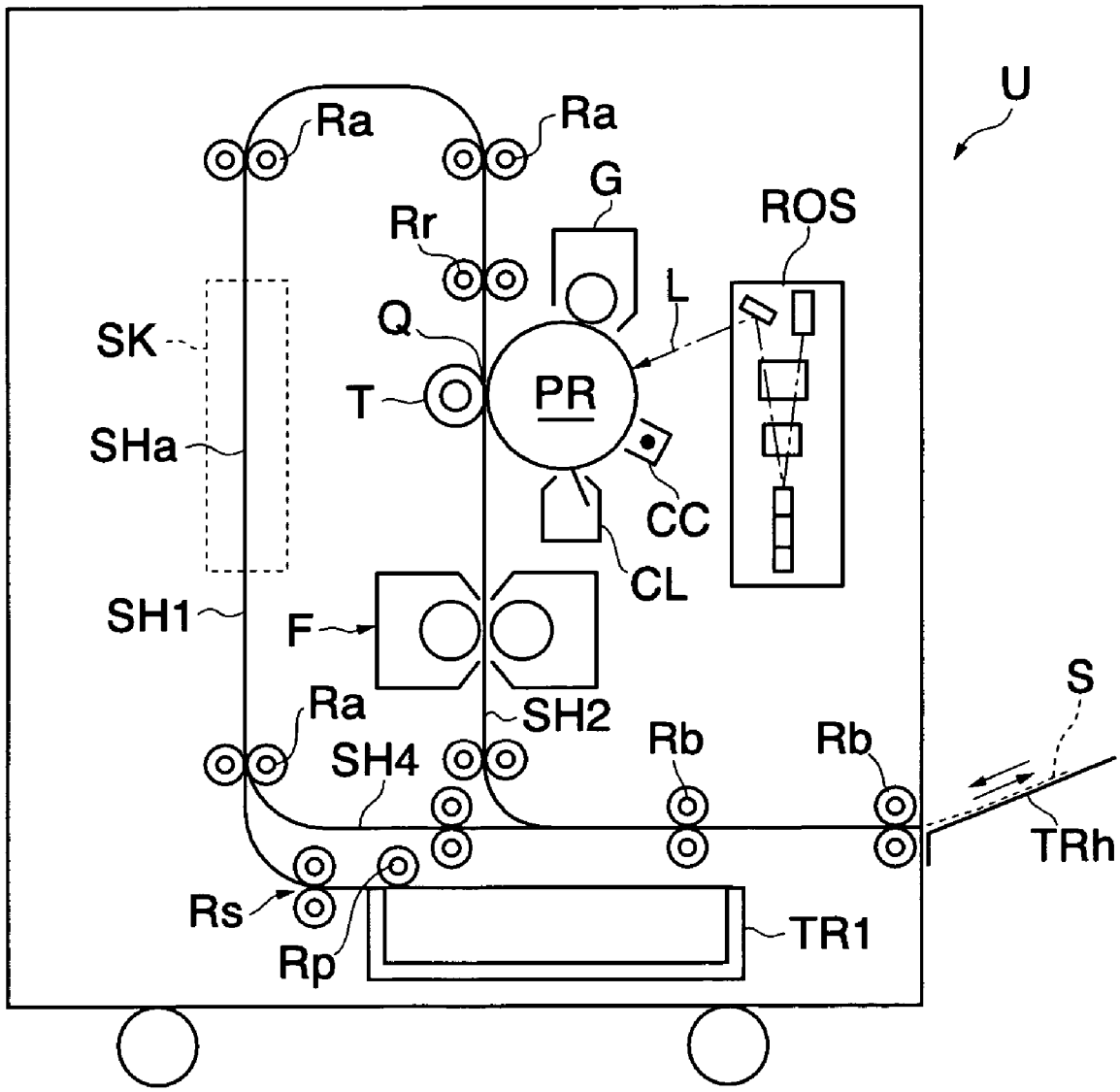
FIG. 10 illustrates an image formation device, which is Embodiment 7 of the invention.

FIG. 10 illustrates an image formation device, which is Embodiment 7 of the invention.

In the description of the image formation device of FIG. 10, which is Embodiment 7 of the invention, constituent elements having counterparts in the image formation device of Embodiment 1 will be denoted by respectively the same signs and their detailed description will be dispensed with.

In the image formation device of this Embodiment 7, the paper feed tray TR1 is arranged in the lower part of the same case as the image recording member G is. Sheets taken out of the paper feed tray TR1 are let pass the sheet size detecting path SHa, which is set in the vertically extending part of the upstream side sheet carrying path SH1, and carried to the transfer area Q.

In a single side recording job, a sheet onto whose first side a toner image has been transferred (an image has been recorded) in the transfer area Q, after the image is fixed by the fixing device F arranged midway on the downstream side sheet carrying path SH2, is discharged to the sheet eject tray TRh by the plural forward/backward rotating feed rollers Rb.

In a double side recording job, a sheet taken out of the paper feed tray TR1, after its size before recording on the first side is detected when it passes the sheet size detecting path SHa set on the vertically extending part of the upstream side sheet carrying path SH1, is carried to the transfer area Q. The sheet onto whose first side a toner image has been transferred (an image has been recorded) in the transfer area Q, after the image is fixed by the fixing device F arranged midway on the downstream side sheet carrying path SH2, is discharged to the sheet eject tray TRh by the plural forward/backward rotating feed rollers Rb. Before the rear end of the sheet discharged to the sheet eject tray TRh passes the forward/backward rotating feed rollers Rb, the forward/backward rotating feed rollers Rb are reversed in rotation, and the sheet is switched back to be carried to the sheet returning path SH4. This sheet is returned to the sheet size detecting path SHa and, when it passes the sheet size detecting path SHa, its size before recording on the second side is detected.

Therefore, as the image formation device of this Embodiment 7, like Embodiment 1, detects the sheet size before recording on the first side and that before recording on the second side with the same sheet size detecting member SK, the magnification of the image to be formed on the second side of the sheet can be accurately corrected.

Embodiment 8

Figure 11:
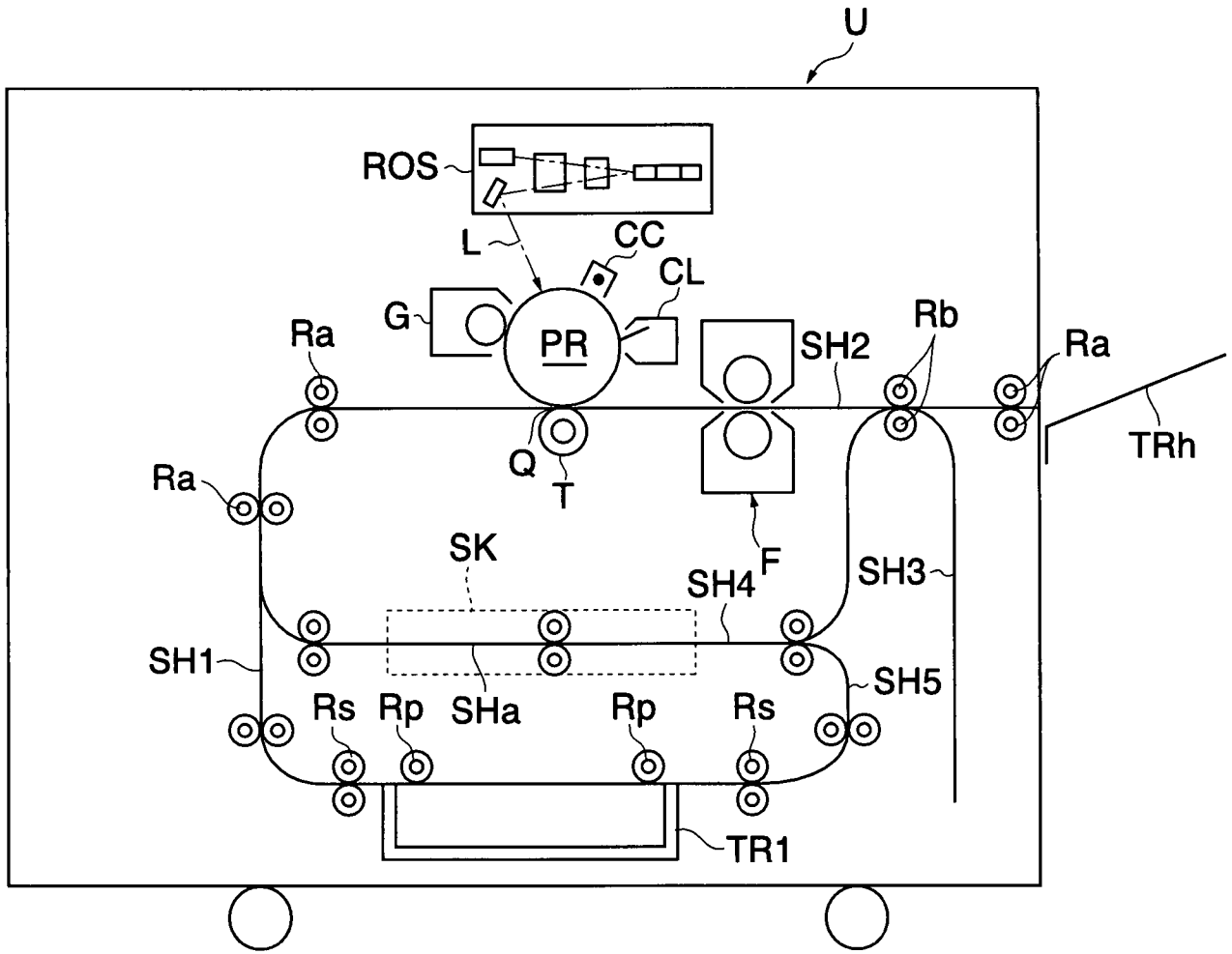
FIG. 11 illustrates an image formation device, which is Embodiment 8 of the invention.

FIG. 11 illustrates an image formation device, which is Embodiment 8 of the invention.

In the description of the image formation device of FIG. 11, which is Embodiment 8 of the invention, constituent elements having counterparts in the image formation device of Embodiment 1 will be denoted by respectively the same signs and their detailed description will be dispensed with.

In the image formation device of this Embodiment 8, the paper feed tray TR1 is arranged in the lower part of the same case as the image recording member G is. At the top of one end side (left end side) and of the other end side (right end side) of the paper feed tray TR1, there are provided take-out rollers Rp and Rp for taking out sheets on one side and the other side, respectively. Between one end side (left end side) of the paper feed tray TR1 and the transfer area (image recording position) Q is arranged the upstream side sheet carrying path SH1.

Sheets fed from the other end side (right end side) of the paper feed tray TR1, passing the upstream side sheet carrying path SH5 for double side recording and the sheet size detecting path SHa, which is set on the sheet returning path SH4, are carried to the upstream side sheet carrying path SH1.

In a single side recoding job, every sheet is fed from the upstream side sheet carrying path SH1 on one end side (left end side) of the paper feed tray TR1.

In a double side recording job, the first sheet of the job is fed from the upstream side sheet carrying path SH5 for double side recording on the other end side (right end side) of the paper feed tray TR1, its size before recording on the first side is detected when it passes the sheet size detecting path SHa set on the sheet returning path SH4, and a toner image is transferred (an image is recorded) onto the first side of the sheet in the transfer area Q. The image on this sheet is fixed by the fixing device F arranged on the downstream side sheet carrying path SH2. This one sided recorded sheet is inverted on the sheet inverting path SH3 downstream from the forward/backward rotating feed rollers Rb arranged on the downstream side sheet carrying path SH2, and carried to the sheet returning path SH4. The size of this sheet before recording on the second side is detected when it passes the sheet size detecting path SHa set on the sheet returning path SH4.

Therefore, as the image formation device of this Embodiment 8, like Embodiment 1, detects the sheet size before recording on the first side and that before recording on the second side with the same sheet size detecting member SK, the magnification of the image to be formed on the second side of the sheet can be accurately corrected.

Embodiment 9

Figure 12:
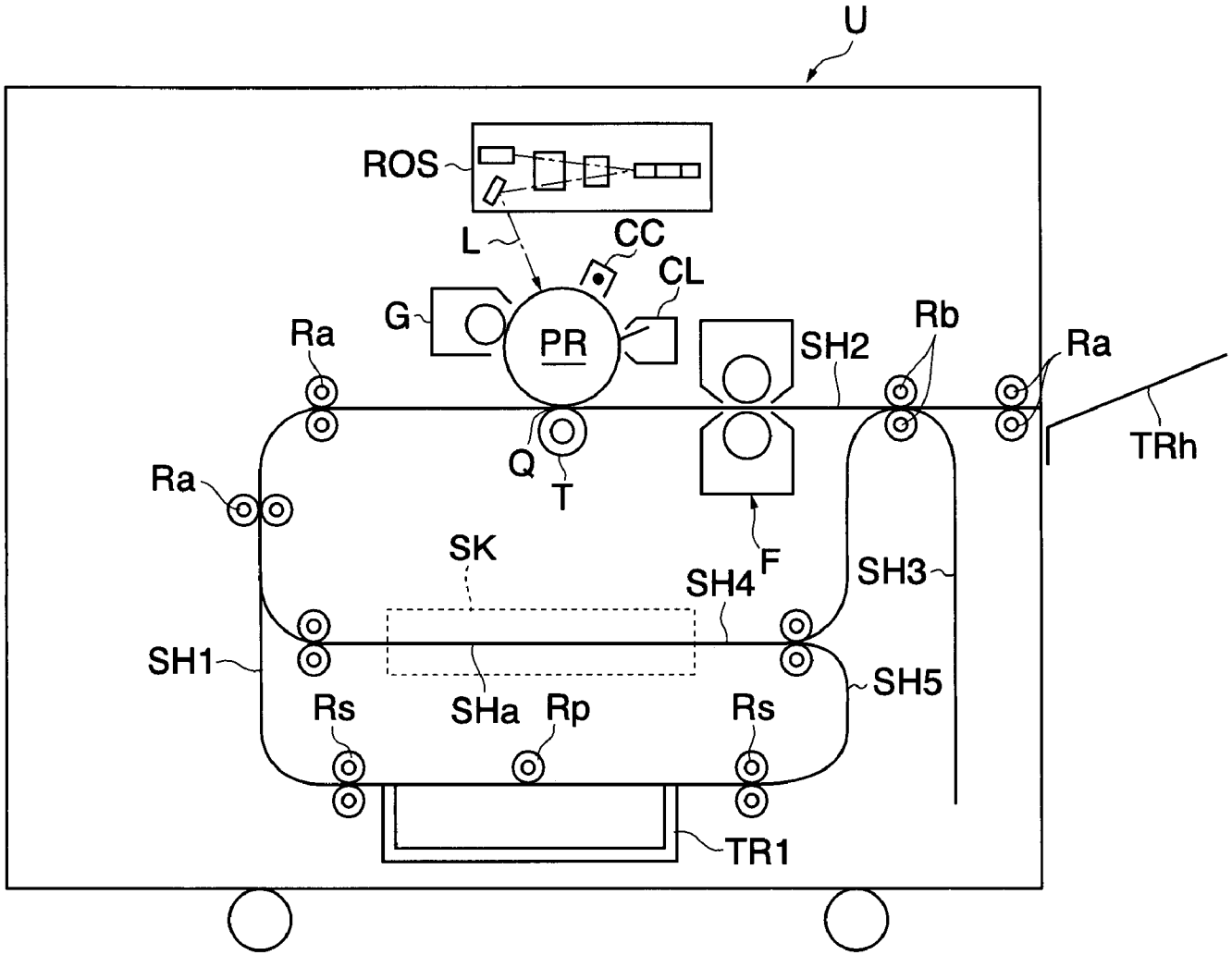
FIG. 12 illustrates an image formation device, which is Embodiment 9 of the invention.

FIG. 12 illustrates an image formation device, which is Embodiment 9 of the invention.

In the description of the image formation device of FIG. 12, which is Embodiment 9 of the invention, constituent elements having counterparts in the image formation device of Embodiment 8 shown in FIG. 11 will be denoted by respectively the same signs and their detailed description will be dispensed with.

While the take-out rollers Rp for taking out sheets from the paper feed tray TR1 are arranged above the right and left ends of the paper feed tray TR1 in the image formation device of Embodiment 8 shown in FIG. 11, a take-out roller Rp in the image formation device of this Embodiment 9 shown in FIG. 12 is arranged above the central part of the paper feed tray TR1 in the lateral direction.

Referring to FIG. 12, the take-out roller Rp of Embodiment 9 can be rotated in either the forward or the backward direction, and therefore sheets in the paper feed tray TR1 can be selectively fed to either the upstream side sheet carrying path SH1 on the left side or the upstream side sheet carrying path SH5 for double side recording on the right side. This embodiment is similar to Embodiment 8 in all other aspects of configuration and actions.

Embodiment 10

Figure 13:
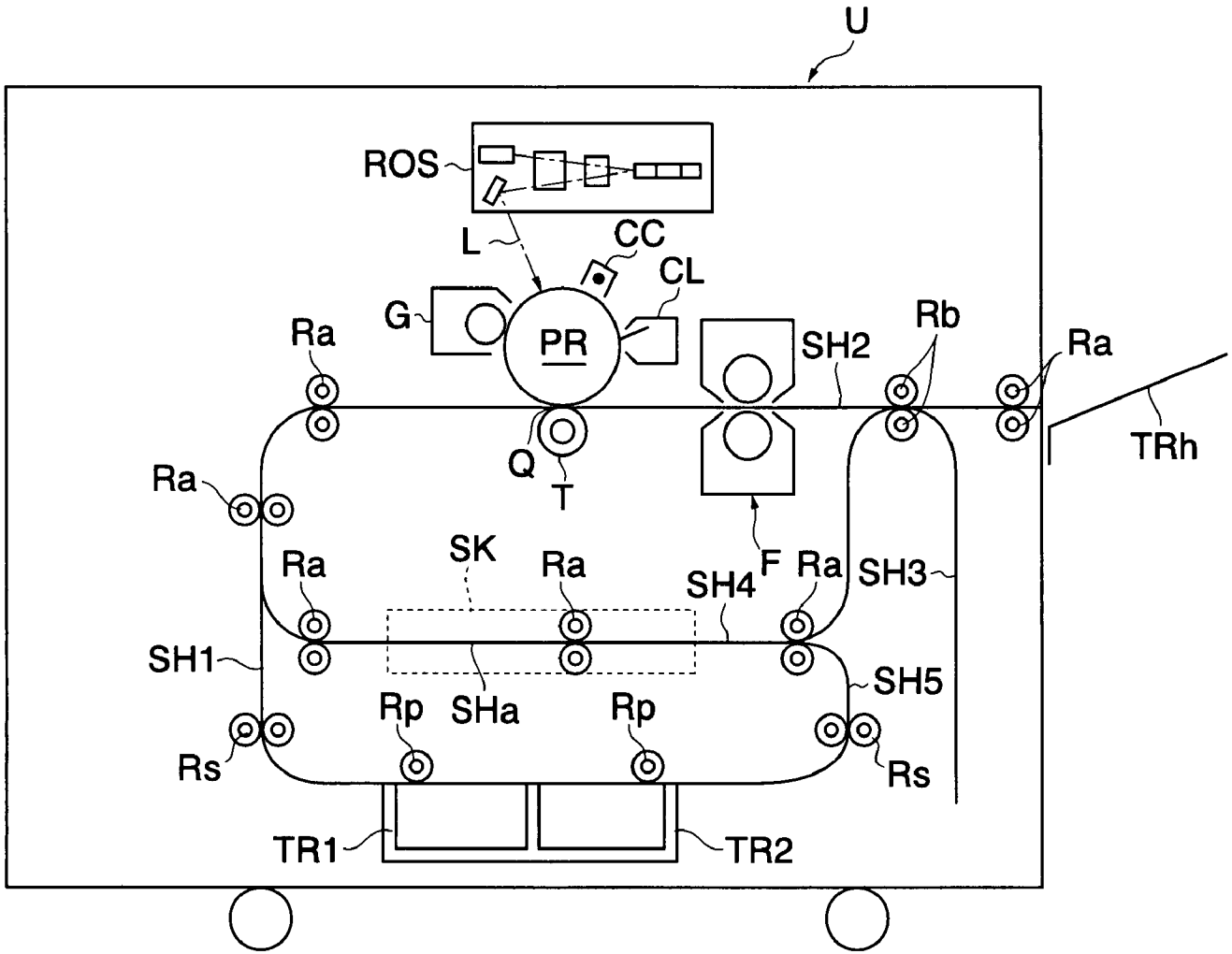
FIG. 13 illustrates an image formation device, which is Embodiment 10 of the invention.

FIG. 13 illustrates an image formation device, which is Embodiment 10 of the invention.

Figure 14:
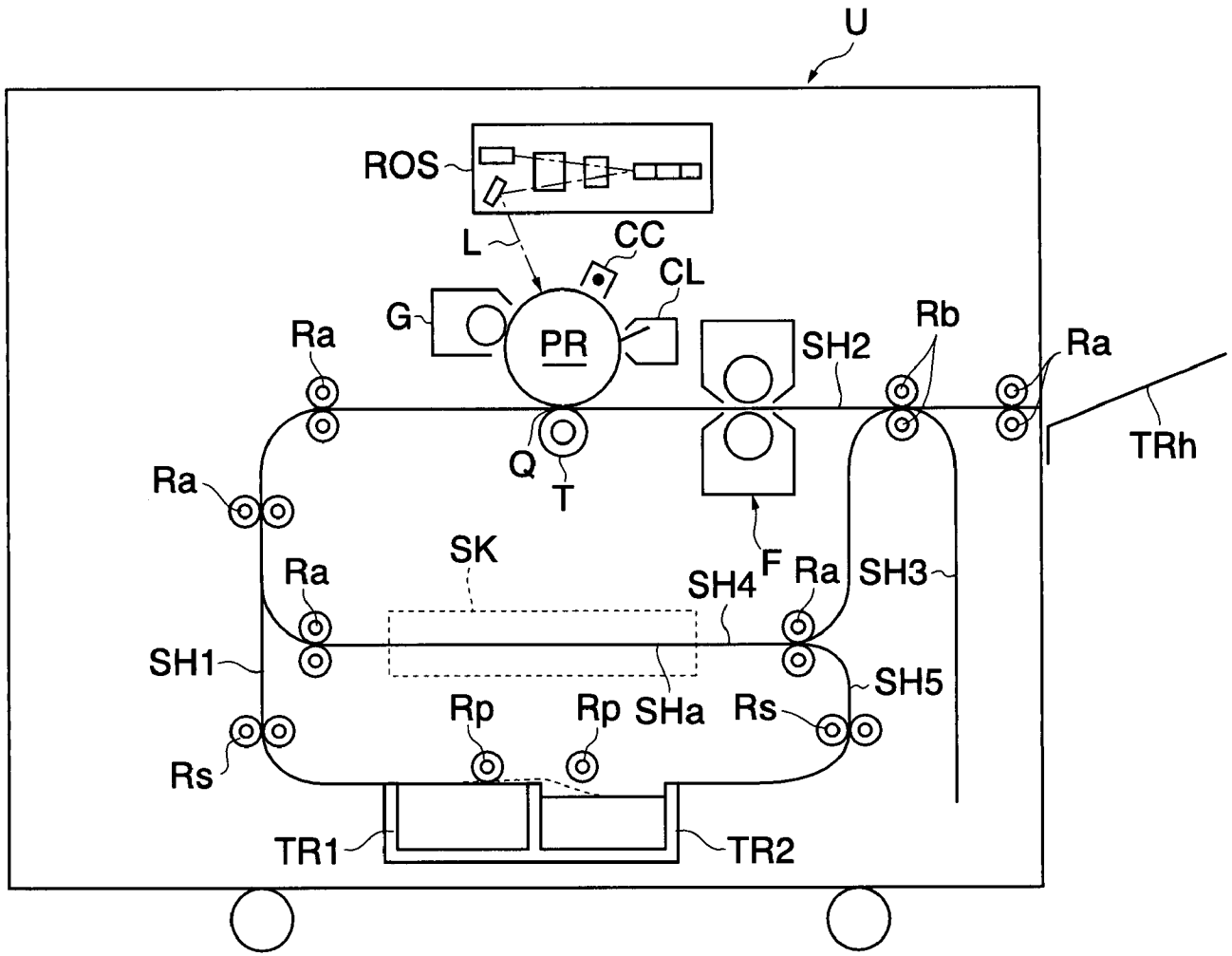
FIG. 14 illustrates an image formation device, which is Embodiment 11 of the invention.

In the description of the image formation device of FIG. 14, which is Embodiment 10 of the invention, constituent elements having counterparts in the image formation device of Embodiment 8 shown in FIG. 11 will be denoted by respectively the same signs and their detailed description will be dispensed with.

While the take-out rollers Rp for taking out sheets from the single paper feed tray TR1 are arranged above the right and left ends of the paper feed tray TR1 in the image formation device of Embodiment 8 shown in FIG. 11, in the image formation device of this Embodiment 10 shown in FIG. 13 there are arranged, adjacent to each other, a left side paper feed tray TR1 and a right side paper feed tray TR2, each for accommodating sheets of the same size. At the top of the left side end of the left side paper feed tray TR1 is provided a take-out roller Rp for taking out sheets to the upstream side sheet carrying path SH1. Similarly, above the right side end of the right side paper feed tray TR2 is provided another take-out roller Rp for taking out sheets to the upstream side sheet carrying path SH5 for double side recording.

In this Embodiment 10, in a single side job, every sheet is fed from the upstream side sheet carrying path SH1 to the left of the left side paper feed tray TR1.

In a double side job, the first sheet of the job is fed from the upstream side sheet carrying path SH5 for double side recording to the right of the right side paper feed tray TR2 and, as in Embodiment 8, the sheet size before recording on the first side and that size before recording on the second side are detected.

Therefore, as the image formation device of this Embodiment 10, like Embodiment 8, detects the sheet size before recording on the first side and that before recording on the second side with the same sheet size detecting member SK, the magnification of the image to be formed on the second side of the sheet can be accurately corrected.

Embodiment 11

FIG. 14 illustrates an image formation device, which is Embodiment 11 of the invention.

In the description of the image formation device of FIG. 14, which is Embodiment 11 of the invention, constituent elements having counterparts in the image formation device of Embodiment 10 shown in FIG. 13 will be denoted by respectively the same signs and their detailed description will be dispensed with.

While the take-out rollers Rp for taking out sheets from the left side paper feed tray TR1 and the right side paper feed tray TR2, each accommodating sheets of the same size, are arranged above the left end of the left side paper feed tray TR1 and the right end of the right side paper feed tray TR2 in the image formation device of Embodiment 10 shown in FIG. 13, in the image formation device of this Embodiment 11 shown in FIG. 14 there are provided take-out rollers Rp, reversible in rotational direction, above a part somewhat right ward from the central part of the left side paper feed tray TR1 in the lateral direction and above a part somewhat left ward from the central part of the right side paper feed tray TR2 in the lateral direction.

The distance between the take-out rollers Rp and Rp of the left and right paper feed trays TR1 and TR2 in the lateral direction is set shorter than the length of the sheets, in the carrying direction, accommodated in the paper feed trays TR1 and TR2. Therefore, when either of the left and right paper feed trays TR1 and TR2 has run out of sheets, it is possible to take out sheets in the other paper feed tray by its reversible take-out roller Rp, supply them to the emptied paper feed tray, and accommodate them in this emptied paper feed tray by its take-out roller.

The sheet carrying methods of this Embodiment 11 both in a single side job and in a double side job are the same as those of Embodiment 10.

Therefore, as the image formation device of this Embodiment 11, like Embodiment 10, detects the sheet size before recording on the first side and that before recording on the second side with the same sheet size detecting member SK, the magnification of the image to be formed on the second side of the sheet can be accurately corrected.

Embodiment 12

Figure 15:
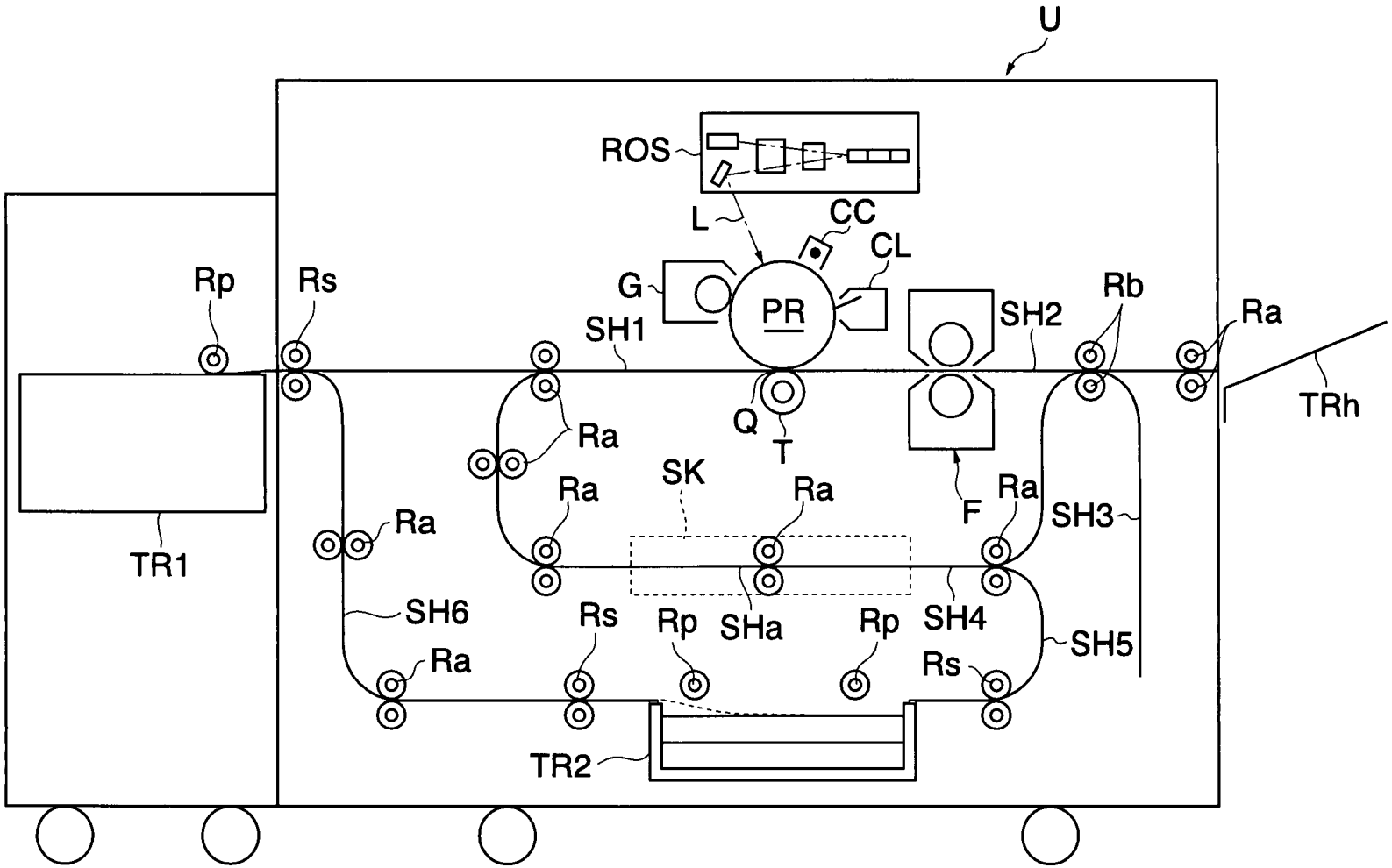
FIG. 15 illustrates an image formation device, which is Embodiment 12 of the invention.

FIG. 15 illustrates an image formation device, which is Embodiment 12 of the invention.

In the description of the image formation device of FIG. 15, which is Embodiment 12 of the invention, constituent elements having counterparts in the image formation device of Embodiment 1 will be denoted by respectively the same signs and their detailed description will be dispensed with.

In the image formation device of Embodiment 12 shown in FIG. 15, a second paper feed tray TR2 is provided apart from the paper feed tray TR1. The second paper feed tray TR2 is arranged underneath the sheet size detecting path SHa. Sheets of the same size are accommodated in the paper feed trays TR1 and TR2.

Between the paper feed tray TR1 and the second paper feed tray TR2, there is arranged a replenishing paper feed path SH6 for replenishing one paper feed tray with sheets from the other paper feed tray. Therefore, even if either paper feed tray runs out of sheets, it can be replenished with sheets from the other paper feed tray.

In this Embodiment 12, in a single side job, sheets are fed from the paper feed tray TR1.

In a double side job, the first sheet of the job is fed from the paper feed tray TR2 to the upstream side sheet carrying path SH5 for double side recording, and carried to the upstream side sheet carrying path SH1 via the sheet size detecting path SHa set on the sheet returning path SH4. A toner image is transferred (an image is recorded) onto the first side of this sheet in the transfer area Q after the sheet size before recording on the first side is detected when passing the sheet size detecting path SHa. The toner image on this sheet is fixed by the fixing device F arranged on the downstream side sheet carrying path SH2. This one side recorded sheet is inverted on the sheet inverting path SH3, and its size before recording on the second side is detected when passing the sheet size detecting path SHa set on the sheet returning path SH4.

Correction of the image magnification for the second sides of the second and subsequent sheets of the job can be accomplished by either of the following methods (1) and (2).

(1) As the corrected magnification for the second and subsequent sheets of the job, the image correction magnification for the first sheet of the job is used. In this case, the second and subsequent sheets are fed from the paper feed tray TR1.

(2) The sheet sizes of every one of the second and subsequent sheets of the job before recording on the first-side and before recording on the second side are detected, and the image correction magnification for the second side is computed on a sheet-by-sheet basis. In this case, the second and subsequent sheets are fed from the paper feed tray TR2.

Therefore, as the image formation device of this Embodiment 12, like Embodiment 1, detects the sheet size before recording on the first side and that before recording on the second side with the same sheet size detecting member SK, the magnification of the image to be formed on the second side can be accurately corrected.

Embodiment 13

Figure 16:
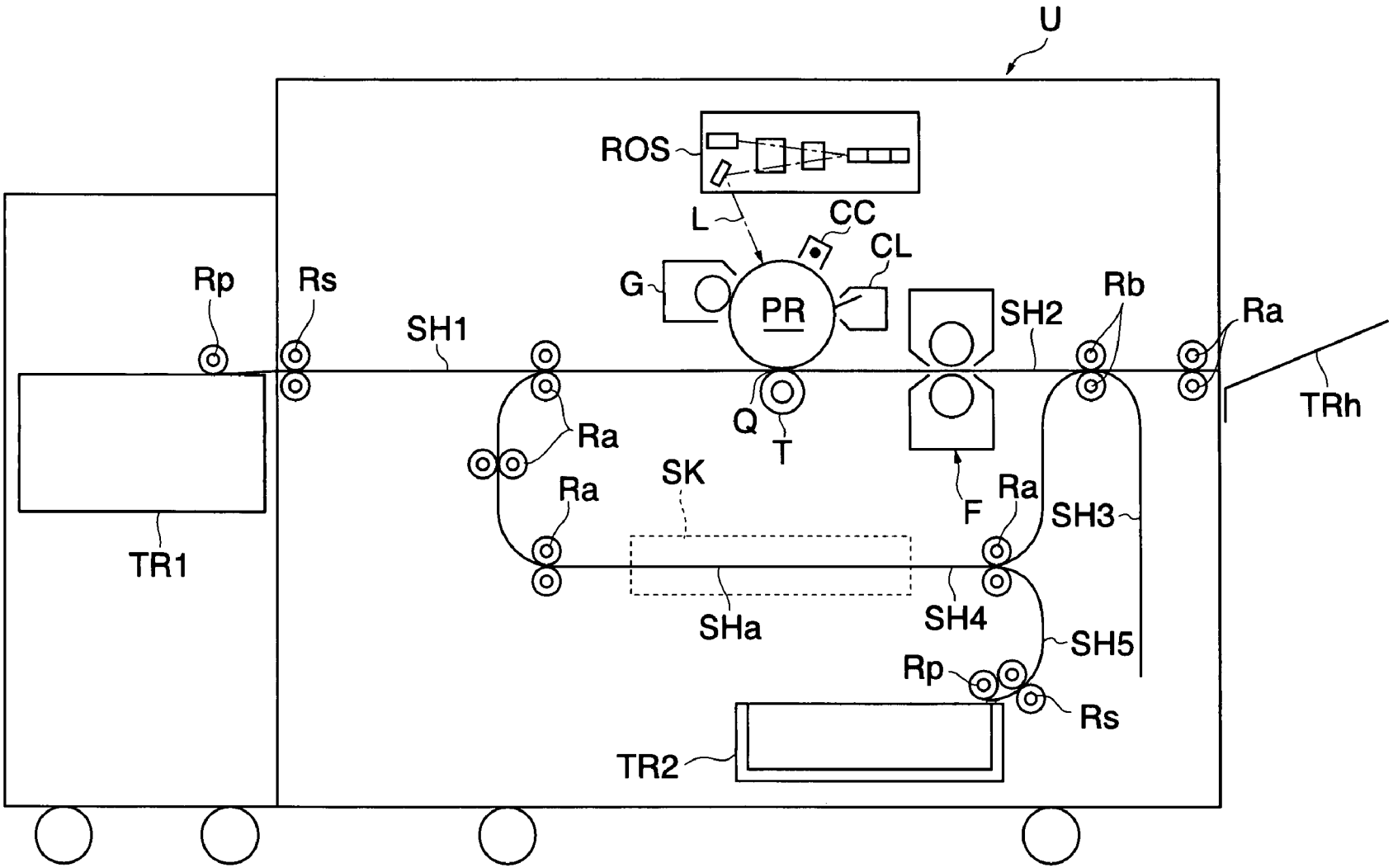
FIG. 16 illustrates an image formation device, which is Embodiment 13 of the invention.

FIG. 16 illustrates an image formation device, which is Embodiment 13 of the invention.

In the description of the image formation device of FIG. 16, which is Embodiment 13 of the invention, constituent elements having counterparts in the image formation device of Embodiment 12 shown in FIG. 15 will be denoted by respectively the same signs and their detailed description will be dispensed with.

In the image formation device U of this Embodiment 13, the take-out roller Rp and separating members Rs of the left side provided on the replenishing paper feed path SH6 and the paper feed tray TR2 in Embodiment 12 shown in FIG. 15 are dispensed with.

Therefore, in this Embodiment 13 shown in FIG. 16, though sheets cannot be diverted between the paper feed trays TR1 and TR2, its other actions are the same as their counterparts in Embodiment 12.

Embodiment 14

Figure 17:
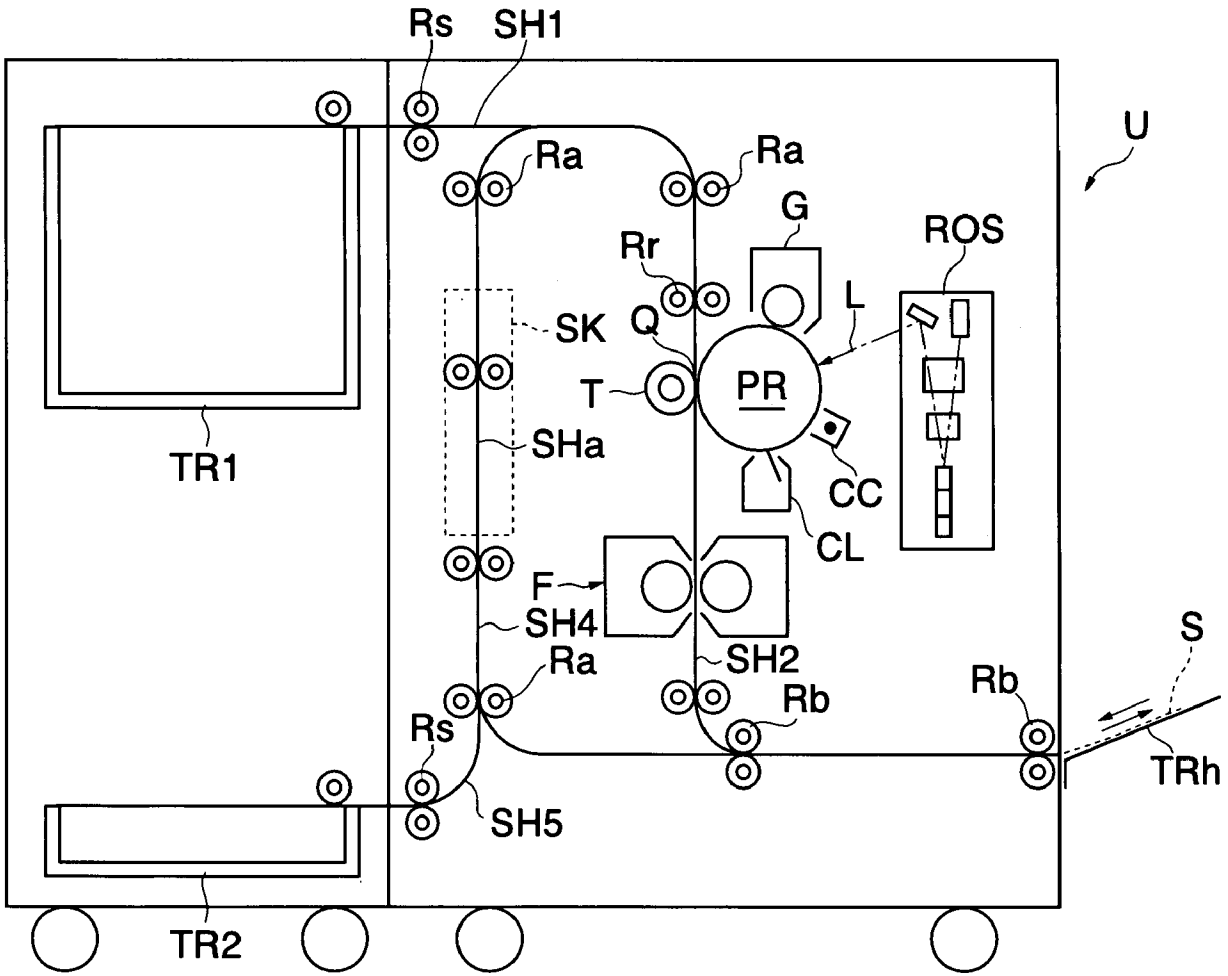
FIG. 17 illustrates an image formation device, which is Embodiment 14 of the invention.

FIG. 17 illustrates an image formation device, which is Embodiment 14 of the invention.

In the description of the image formation device of FIG. 17, which is Embodiment 14 of the invention, constituent elements having counterparts in the image formation device of Embodiment 7 will be denoted by respectively the same signs and their detailed description will be dispensed with.

In the image formation device of this Embodiment 14, the paper feed trays TR1 and TR2 are arranged vertically apart from each other in a case different from that of the image recording member G. Sheets taken out of the upper paper feed tray TR1 are carried along the upstream side sheet carrying path SH1 to the transfer area (image recording position) Q.

In a single side job, the sheet onto whose first side a toner image has been transferred (an image has been recorded) in the transfer area Q, after the image is fixed by the fixing device F arranged on the downstream side sheet carrying path SH2, is discharged to the sheet eject tray TRh by the forward/backward rotating feed rollers Rb.

In a double side job, a sheet taken out of the lower paper feed tray TR2 passes the sheet size detecting path SHa set on the sheet returning path SH4 extending vertically from the upstream side sheet carrying path SH5 for double side recording, and is carried to the transfer area Q via the upstream side sheet carrying path SH1. This sheet, whose size before recording on the first side is detected when passing the sheet size detecting path SHa set on the sheet returning path SH4, is carried to the transfer area Q after its size before recording on the first side is detected. The sheet onto whose first side a toner image has been transferred (an image has been recorded) in the transfer area Q, after the toner image is fixed by the fixing device F arranged midway on the downstream side sheet carrying path SH2, is discharged to the sheet eject tray TRh by the forward/backward rotating feed rollers Rb. Before the rear end of the sheet discharged to the sheet eject tray TRh passes the forward/backward rotating feed rollers Rb, the forward/backward rotating feed rollers Rb are reversed in rotational direction, and the sheet is switched back to be carried to the sheet returning path SH4. This sheet is returned to the sheet size detecting path SHa set on the vertically extending part of the sheet returning path SH4, and its size before recording on the second side is detected when it passes the sheet size detecting path SHa.

Therefore, as the image formation device of this Embodiment 14, like Embodiment 7, detects the sheet size before recording on the first side and that before recording on the second side with the same sheet size detecting member SK, the magnification of the image to be formed on the second side of the sheet can be accurately corrected.

Embodiment 15

Figure 18:
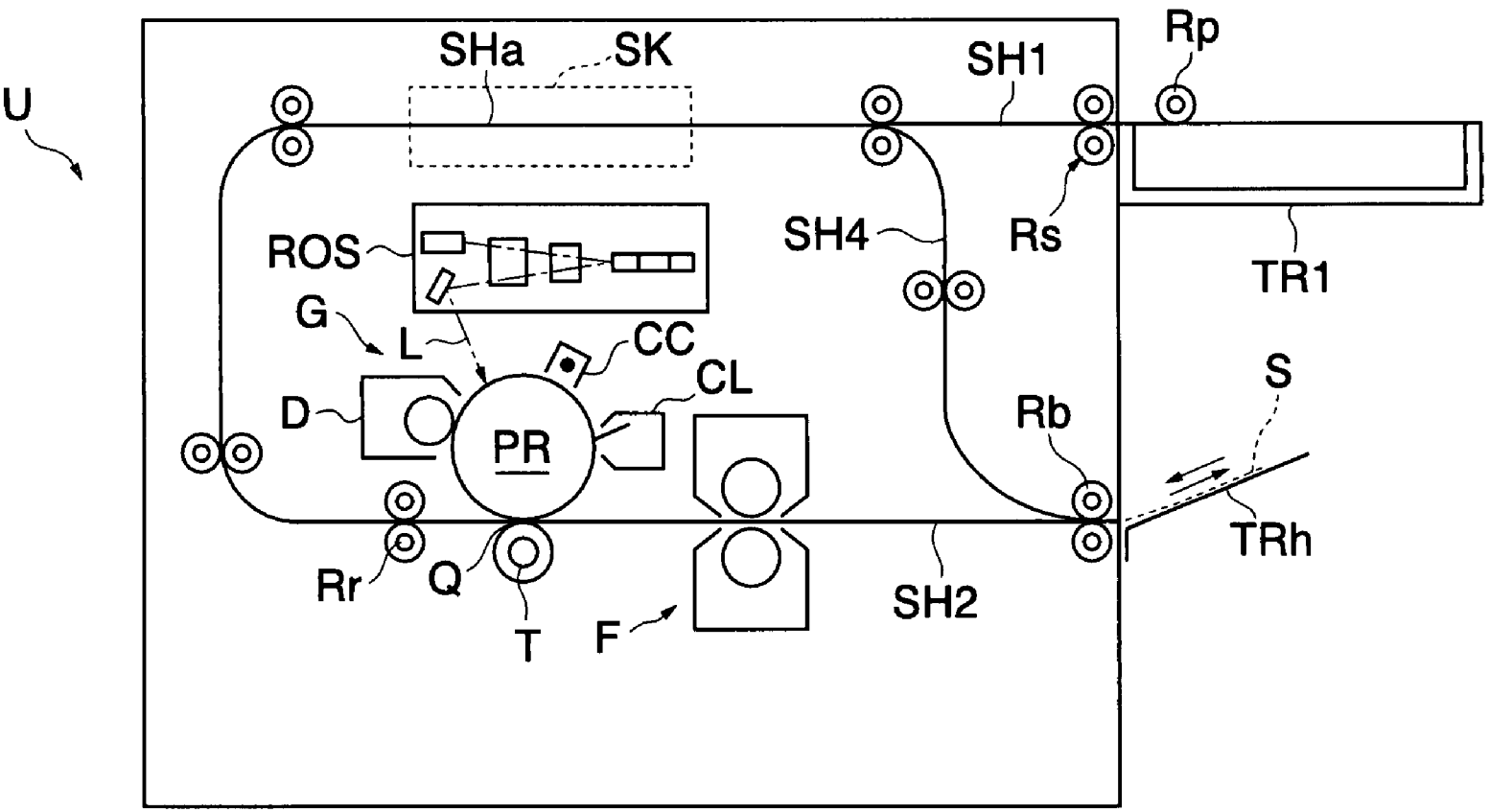
FIG. 18 illustrates an image formation device, which is Embodiment 15 of the invention.

FIG. 18 illustrates an image formation device, which is Embodiment 15 of the invention.

In the description of the image formation device of FIG. 18, which is Embodiment 15 of the invention, constituent elements having counterparts in the image formation device of Embodiment 1 will be denoted by respectively the same signs and their detailed description will be dispensed with.

In the image formation device of this Embodiment 15, the paper feed tray TR1 and the sheet eject tray TRh are arranged to the right of the case of the image recording member G, and the paper feed tray TR1 is arranged above the sheet eject tray TRh. The upstream side sheet carrying path SH1 for carrying sheets from the paper feed tray TR1 to the transfer area Q is arranged above, to the left of and underneath the image recording member G. A sheet carried along the upstream side sheet carrying path SH1 passes above the image recording member G from right to left, then passes the left side of the image recording member G downward from above, and is carried underneath the image recording member G from left to right to reach the transfer area Q.

In a single side job, the sheet onto whose first side a toner image has been transferred (an image has been recorded) in the transfer area Q, after the image is fixed by the fixing device F arranged on the downstream side sheet carrying path SH2, is discharged to the sheet eject tray TRh by the forward/backward rotating feed rollers Rb.

In a double side job, a sheet taken out of the paper feed tray TR1, when it passes the sheet size detecting path SHa set on the part of the upstream side sheet carrying path SH1 arranged above the image recording member G, undergoes detection of its size before recording on the first side. This sheet, on whose first side a toner image is transferred (an image is recorded) in the transfer area Q, is discharged to the sheet eject tray TRh by the forward/backward rotating feed rollers Rb after the toner image is fixed by the fixing device F arranged midway on the downstream side sheet carrying path SH2. Before the rear end of the sheet discharged to this sheet eject tray TRh passes the forward/backward rotating feed rollers Rb, the forward/backward rotating feed rollers Rb are reversed in rotational direction, and the sheet is switched back to be carried to the sheet returning path SH4. This sheet is returned from the sheet returning path SH4 to the sheet size detecting path SHa of the upstream side sheet carrying path SH1, and its size before recording on the second side is detected when it passes the sheet size detecting path SHa.

Therefore, as the image formation device of this Embodiment 15, like Embodiment 14, detects the sheet size before recording on the first side and that before recording on the second side with the same sheet size detecting member SK, the magnification of the image to be formed on the second side of the sheet can be accurately corrected.

Embodiment 16

Figure 19:
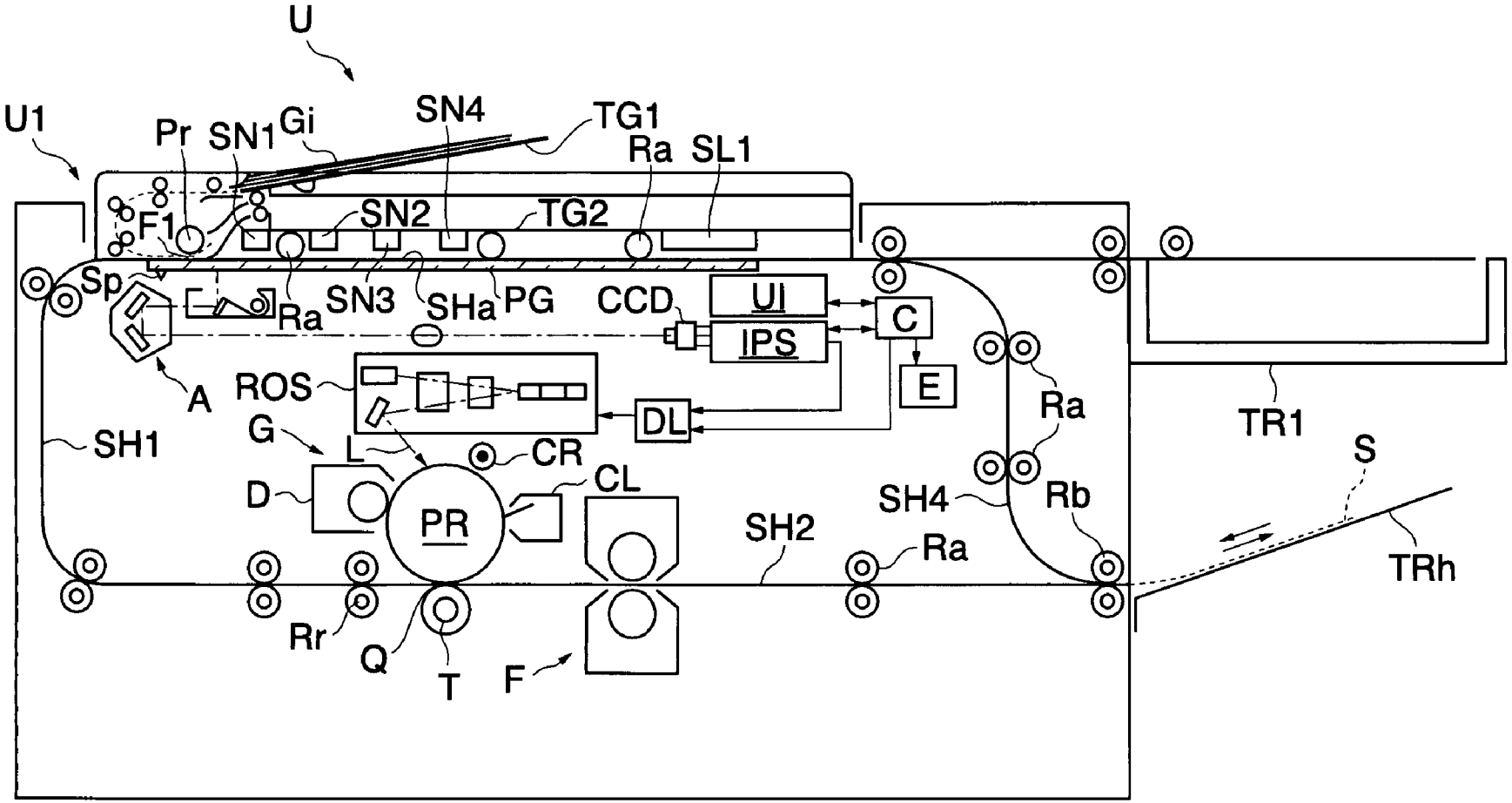
FIG. 19 illustrates an image formation device, which is Embodiment 16 of the invention.

FIG. 19 illustrates an image formation device, which is Embodiment 16 of the invention.

In the description of the image formation device of FIG. 19, which is Embodiment 16 of the invention, constituent elements having counterparts in the image formation device of Embodiment 1 will be denoted by respectively the same signs and their detailed description will be dispensed with.

While the image formation device U of Embodiment 1 is a printer, the image formation device U of this Embodiment 16 is a copying machine. Therefore, at the top of the case accommodating the image recording member G is provided a platen glass PG, and above the platen glass PG is arranged an automatic document feeding device U1. The automatic document feeding device U1, whose rear end (the part being the screen) is connected to a hinge shaft extending laterally, can turn round the hinge shaft vertically. Underneath the automatic document feeding device U1 are rotatably supported the feed rollers Ra in a configuration to allow carriage of the sheet on the platen glass PG leftwards. The automatic document feeding device U1 takes out a document Gi in a document feed tray TG1 and, after having it pass a copying position F1 (a position in which a platen roller Pr is against the platen glass PG) set on the platen glass PG, and discharges the document to a document eject tray TG2.

The copying machine as the image formation device U has a user interface (UI) for enabling the user to enter an operation command signal, such as one to start copying.

Underneath the platen glass are arranged an exposure register sensor (platen register sensor) SP arranged in a platen register position (OPT position) and an exposure optical system A. Reflected light from the document Gi exposed to light from the lamp of the exposure optical system A passes the exposure optical system A, and converges on a CCD (solid state image sensor) An image processing system (IPS) converts document read signals (electrical signals) entered from the CCD into image data, and stores them temporarily.

In the copying machine U of this Embodiment 16, the document read position is set on the upper surface of the platen glass PG and, as will be described afterwards, the upper surface of the platen glass PG is used as the sheet carrying path for image recording (upstream side sheet carrying path) SH1. For this reason, when a document is to be read in the document read position on the upper surface of the platen glass PG, the sheet cannot be carried over the upper surface of the platen glass PG. Therefore, in this Embodiment 16, image recording on an image recording sheet is executed after the document image has been read in the document read process.

To execute image recording onto an image recording sheet, the image data temporarily stored in the IPS are supplied at a prescribed timing to the laser drive circuit DL as image data for latent image formation. The laser drive circuit DL supplies laser drive signals to the ROS (latent image formation device) correspondingly to entered image data.

The power supply circuits E for driving the user interface (UI), IPS, laser drive circuit DL and other drive circuits are controlled in operational timing and other respects by the controller C.

The surface of the image carrier (photosensitive drum) PR of the image formation device (copying machine) U is uniformly electrified by the electrifying roller CR, and an electrostatic latent image is written onto it with a laser beam L emitted from the ROS (latent image writing device). The electrostatic latent image is developed into a toner image by the developing device D. The toner image shifts to the transfer area Q opposite the transfer roller T along with the rotation of the image carrier PR.

Timed with the shifting of the sheet carried from the toner image and the paper feed tray TR1 (to be described afterwards) to the transfer area Q, the power supply circuits E controlled by the controller C apply a transfer voltage of the polarity reverse to the electrification polarity of the developing toner to the transfer roller T. Then the toner image on the image carrier PR is transferred to the sheet.

The upstream side sheet carrying path SH1 is arranged between the paper feed tray TR1 and the transfer area (image recording position) Q. The upstream side sheet carrying path SH1 is a sheet carrying path for letting the plural feed rollers Ra carry sheets taken out of the paper feed tray TR1 to the transfer area Q. Midway on the upstream side sheet carrying path SH1 is set the sheet size detecting path SHa for carrying the sheet S in a state of being held in a planar shape. Adjacent to the paper feed tray TR1 are arranged the paper feed members Rs, and the resistration rollers Rr are arranged adjacent to the transfer area Q.

Sheets S accommodated in the tray TR1 are taken out of the pickup roller Rp at a prescribed timing, and fed to the upstream side sheet carrying path SH1. The fed sheets are separated one by one by the paper feed members Rs having the pressing paper feed roller Rs1 and the separating roller (separating member) Rs2, and each sheet is carried by the plural feed rollers Ra to the sheet size detecting path SHa.

In this image formation device of Embodiment 16 shown in FIG. 19, the paper feed tray TR1 and the sheet eject tray TRh are arranged to the right of the case of the image recording member G, and the paper feed tray TR1 is arranged above the sheet eject tray TRh. The upper surface of the platen glass PG constitutes part of the upstream side sheet carrying path SH1 for carrying sheets from the paper feed tray TR1 to the transfer area Q, and the sheet size detecting path SHa is set on the upper surface of the platen glass PG. Sheets passing this sheet size detecting path SHa undergo size detection by the sheet size detecting member SK (to be described in further detail afterwards with reference FIGS. 20A and 20B).

Figure 20A:
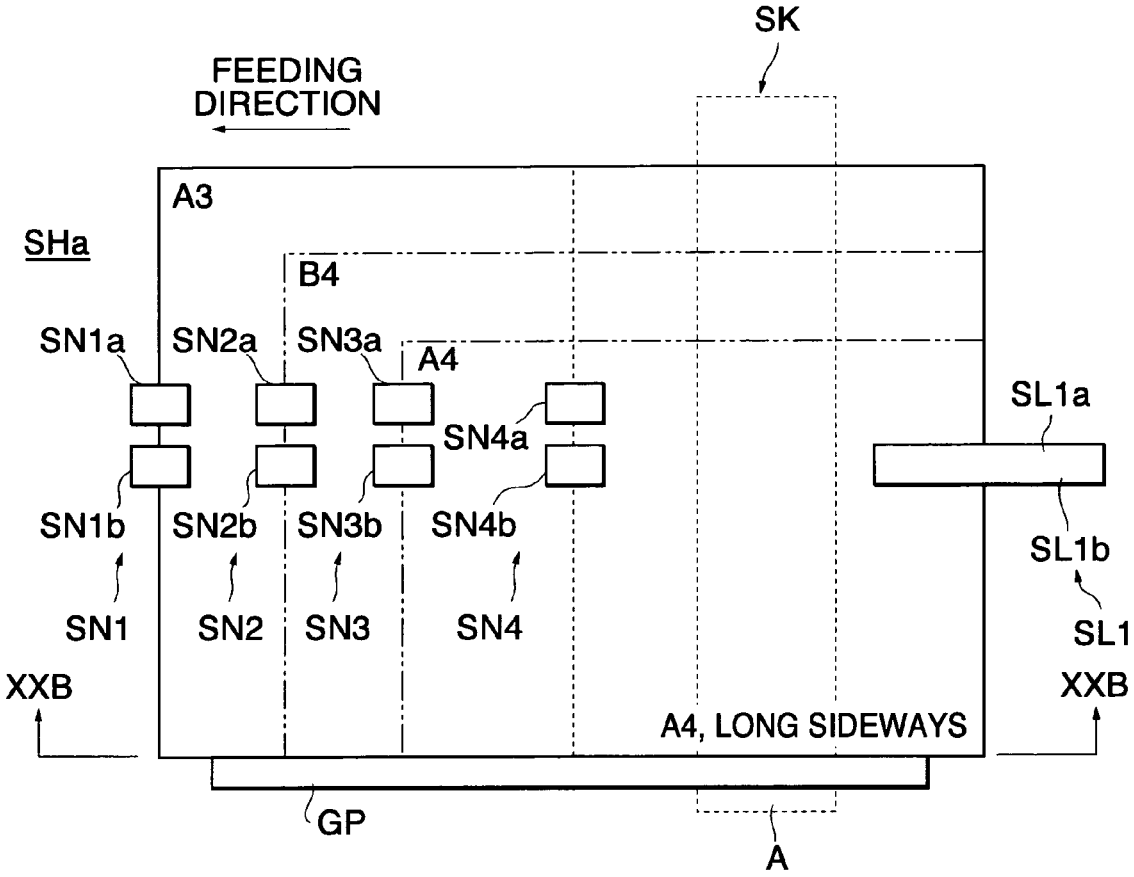
FIGS. 20A and 20B illustrate a sheet size detecting path and sheet size detecting members in the image formation device, which is Embodiment 16 of the invention.
Figure 20B:
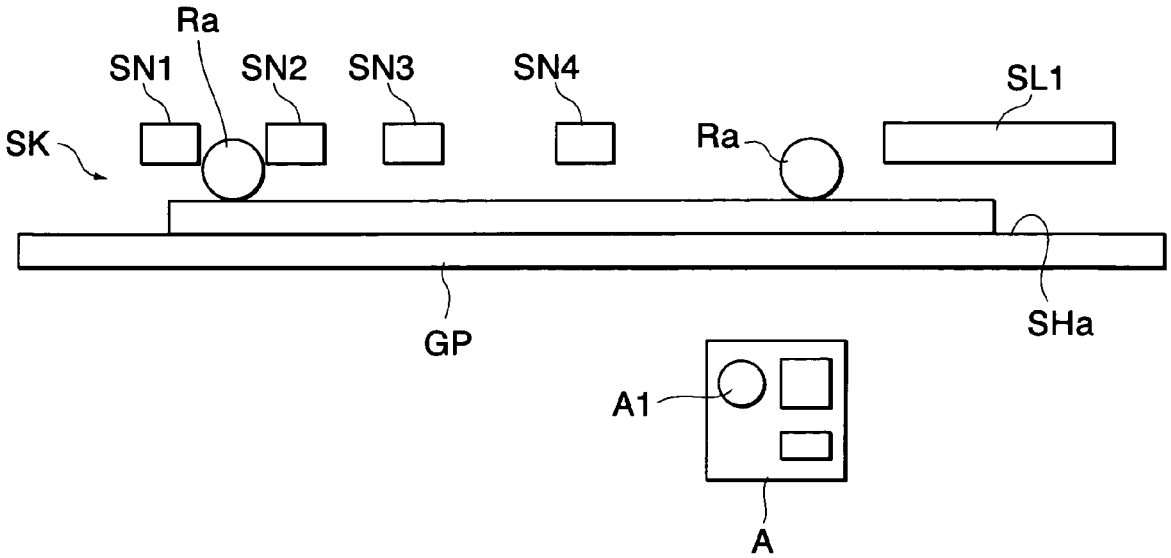

FIGS. 20A and 20B illustrate an image formation device, which is Embodiment 16 of the invention: FIG. 20A showing the arrangement of sheet size detecting members on the sheet size detecting path, and FIG. 20B, a view of the arrangement seen from XXB in FIG. 20A.

Referring to FIGS. 20A and 20B, above the platen glass PG are arranged the photosensors SN1 through SN4 of a reflective type and the vertical direction sensor SL1. The photosensors SN1 through SN4 have light emitting elements SN1*a* through SN4*a* and light receiving elements SN1*b* through SN4*b*, while the vertical direction sensor SL1 has the light source SL1*a*, the Selfoc SR, and the line sensor SL1*b* formed of linear CCDs.

On the basis of detection signals of the photosensors SN1 through SN4 and the vertical direction sensor SL1 at the time sheets are carried over the upper surface of the platen glass PG, the vertical dimension of the sheets can be detected as in. Embodiment 1.

Also, when a sheet carried over the upper surface of the platen glass PG is illuminated by the light source A1 of the exposure optical system A arranged underneath the platen glass PG, the size of the sheet in the horizontal direction can be detected by causing the CCDs to detect the light reflected from the sheet.

Thus, in this Embodiment 16, the sheet size detecting member SK is formed of the photosensors SN1 through SN4, the vertical direction sensor SL1 and the line sensor SL1*b*.

Actions of Embodiment 16

Referring to FIG. 19, the upstream side sheet carrying path SH1 for carrying sheets from the paper feed tray TR1 to the transfer area Q is arranged above the image recording member G (the upper surface of the platen glass PG), to the left of and underneath the same. Sheets carried along the upstream side sheet carrying path SH1 pass above the image recording member G (the upper surface of the platen glass PG) from right to left, then pass the left side of the image recording member G downwards from above, and are carried underneath the image recording member G from left to right to reach the transfer area Q.

In a single side job, a sheet onto whose first side a toner image has been transferred (an image has been recorded) in the transfer area Q is discharged to the sheet eject tray TRh by the forward/backward rotating feed rollers Rb after the toner image has been fixed by the fixing device F arranged on the downstream side sheet carrying path SH2.

In a double side job, a sheet taken out of the paper feed tray TR1 undergoes detection of its size before recording on the first side when it passes the sheet size detecting path SHa set on the part of the upstream side sheet carrying path SH1 arranged above the image recording member G (the upper surface of the platen glass PG). This sheet, after a toner image is transferred (an image is recorded) onto its first side in the transfer area Q and after the toner image is fixed by the fixing device F arranged midway on the downstream side sheet carrying path SH2, is partly discharged to the sheet eject tray TRh by the forward/backward rotating feed rollers Rb. Before the rear end of this sheet discharged to the sheet eject tray TRh passes the forward/backward rotating feed rollers Rb, the forward/backward rotating feed rollers Rb are reversed in rotation, and the sheet is switched back to be carried to the sheet returning path SH4. This one side recorded sheet is returned from the sheet returning path SH4 to the sheet size detecting path SHa of the upstream side sheet carrying path SH1, and its size before recording on the second side is detected when it passes the sheet size detecting path SHa.

Therefore, as the image formation device of this Embodiment 16, like Embodiment 1, detects the sheet size before recording on the first side and that before recording on the second side with the same sheet size detecting member SK, the magnification of the image to be formed on the second side of the sheet can be accurately corrected.

Embodiment 17

Figure 21:
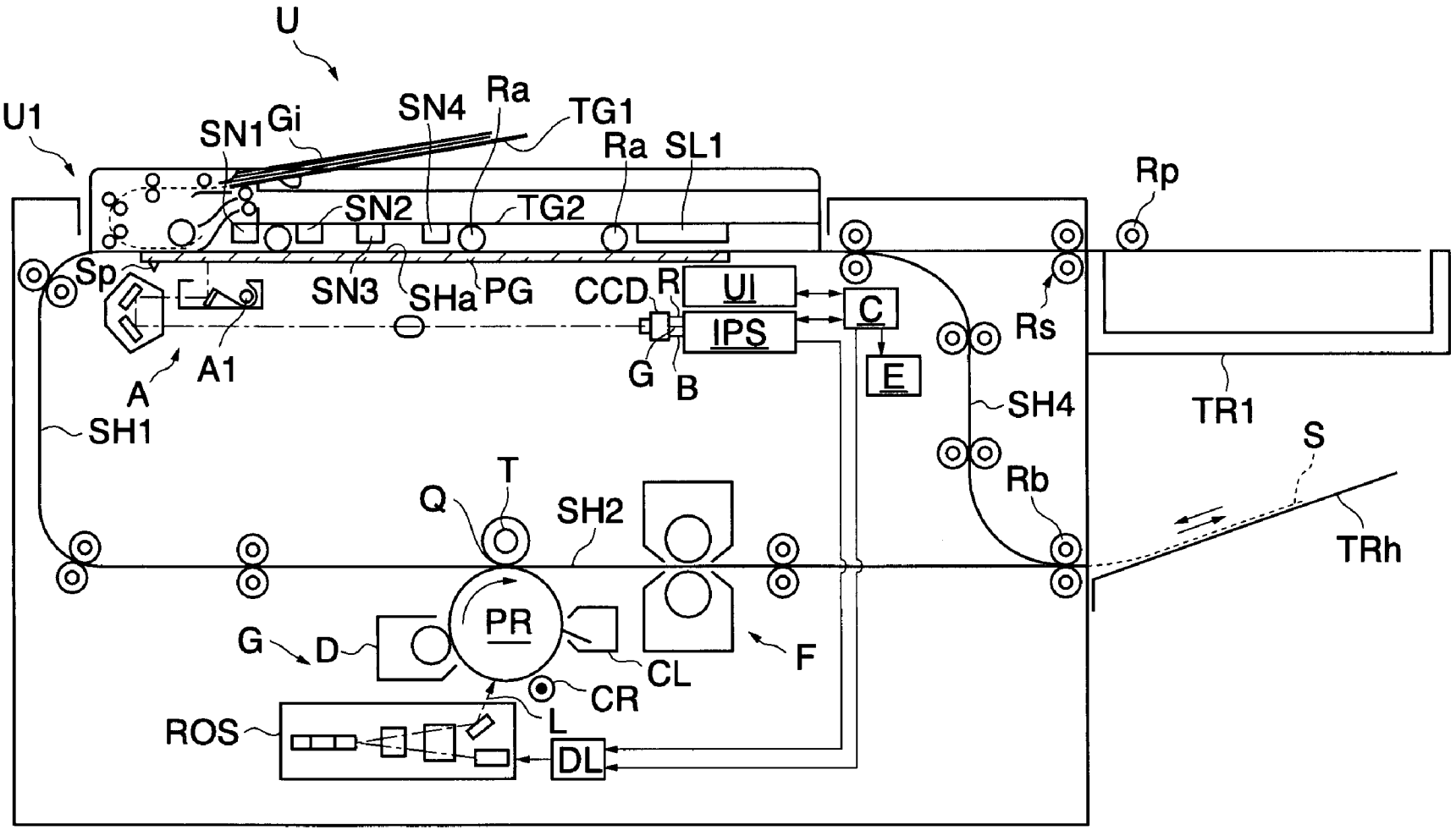
FIG. 21 illustrates an image formation device, which is Embodiment 17 of the invention.

FIG. 21 illustrates an image formation device, which is Embodiment 17 of the invention.

In the description of the image formation device of FIG. 21, which is Embodiment 17 of the invention, constituent elements having counterparts in the image formation device U of Embodiment 16 shown in FIG. 19 will be denoted by respectively the same signs and their detailed description will be dispensed with.

Referring to FIG. 21, in the image formation device U of this Embodiment 17, the arrangement of the image recording member G is vertically inverse to that of the image recording member G of Embodiment 16 shown in FIG. 19. Thus in this Embodiment 17, the transfer roller T is arranged above the image carrier PR.

This Embodiment 17 shown in FIG. 21 is the same as Embodiment 16 shown in FIG. 19 in all other aspects of configuration and actions.

Embodiment 18

Figure 22:
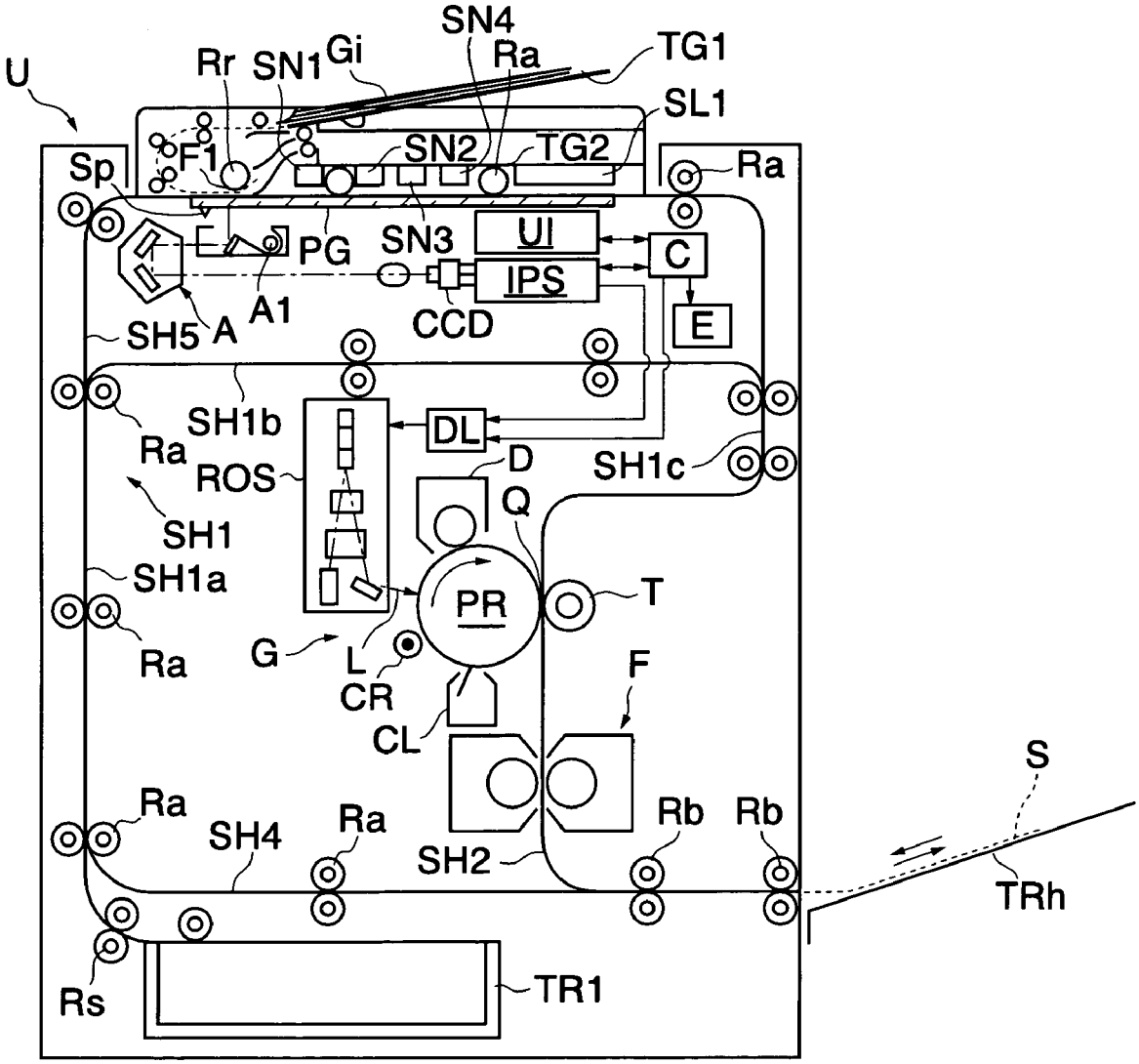
FIG. 22 illustrates an image formation device, which is Embodiment 18 of the invention.

FIG. 22 illustrates an image formation device, which is Embodiment 18 of the invention.

In the description of the image formation device of FIG. 22, which is Embodiment 18 of the invention, constituent elements having counterparts in the image formation device of Embodiment 16 will be denoted by respectively the same signs and their detailed description will be dispensed with.

In the image formation device U of this Embodiment 18, the paper feed tray TR1 is arranged in the lower part of the same case as the case of the image recording member G. The upstream side sheet carrying path SH1 from the paper feed tray TR1 to the transfer area (image recording position) Q has a perpendicular portion SH1*a* extending upward from the left end of the paper feed tray TR1, a horizontal portion SH1*b* bending right ward from the upper end of the perpendicular portion and crossing the upper side of the image recording member G from left to right, and a right side connecting portion SH1*c* bending downward from the right end of the horizontal portion SH1*b* to be connected to the transfer area Q.

Above the horizontal portion SH1*b* is provided the platen glass PG, and above the platen glass PG there is supported an automatic document feeding device. The upper surface of the platen glass PG, as in Embodiment 16, constitutes the sheet size detecting path SHa, and this sheet size detecting path SHa constitutes part of the upstream side sheet carrying path SH5 for double side recording to be described afterwards. Sheets carried along the sheet size detecting path SHa undergo size detection by a sheet size detecting member similar to the sheet size detecting member SK in Embodiment 16 shown in FIGS. 20A and 20B.

The upstream side sheet carrying path SH5 for double side recording extending upward from the upper end of the perpendicular portion SH1*a* of the upstream side sheet carrying path SH1 has the sheet size detecting path SHa on the upper surface of the platen glass PG, and is connected to the upper end of the right side connecting portion SH1*c*.

Actions of Embodiment 18

This Embodiment 18, when executing a single side job, carries sheets from the paper feed tray TR1 to the transfer area Q via the perpendicular portion SH1*a*, the horizontal portion SH1*b* and the right side connecting portion SH1*c* of the upstream side sheet carrying path SH1. When performing a double side job, however, it carries the first sheet of the job to the transfer area Q via the upstream side sheet carrying path SH5 for double side recording and the sheet size detecting path SHa. This undergoes detection of its size before recording on one side when it passes the sheet size detecting path SHa and, after an image is recorded on one side and after the toner image is fixed by the fixing device F arranged midway on the downstream side sheet carrying path SH2, is partly discharged to the sheet eject tray TRh by the forward/backward rotating feed rollers Rb. Before the rear end of this sheet discharged to the sheet eject tray TRh passes the plural forward/backward rotating feed rollers Rb arranged on the sheet eject tray TRh side, the forward/backward rotating feed rollers Rb are reversed in rotation, and the sheet is switched back to be carried to the sheet returning path SH4. This one side recorded sheet is returned from the sheet returning path SH4 to the sheet size detecting path SHa of the upstream side sheet carrying path SH5 for double side recording via the upstream side sheet carrying path SH1, and its size before recording on the second side is detected when it passes the sheet size detecting path SHa.

Therefore, as the image formation device of this Embodiment 18, like Embodiment 16, detects the sheet size before recording on the first side and that before recording on the second side with the same sheet size detecting member SK, the magnification of the image to be formed on the second side can be accurately corrected.

Embodiment 19

Figure 23:
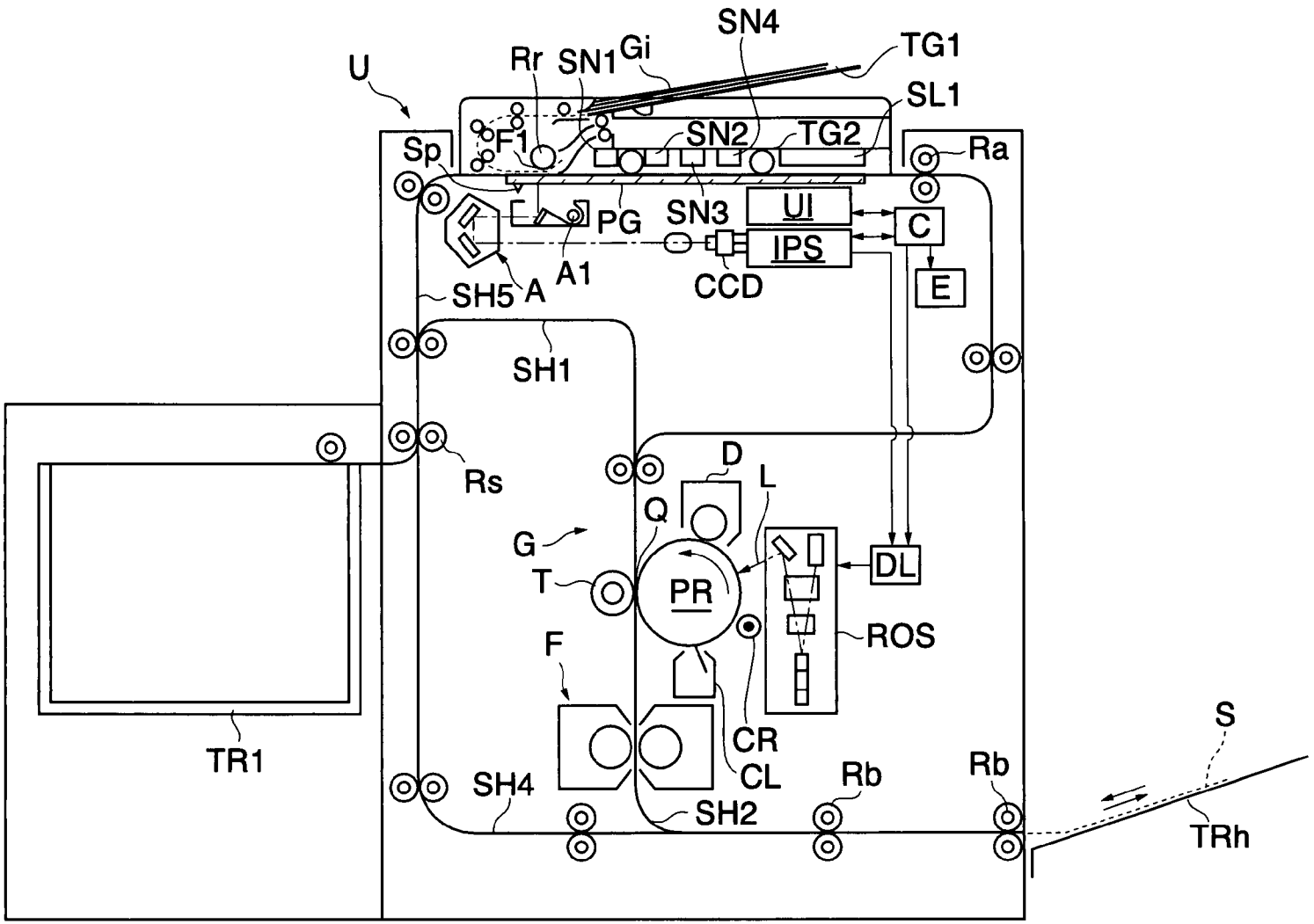
FIG. 23 illustrates an image formation device, which is Embodiment 19 of the invention.

FIG. 23 illustrates an image formation device, which is Embodiment 19 of the invention.

In the description of the image formation device of FIG. 23, which is Embodiment 19 of the invention, constituent elements having counterparts in the image formation device U of Embodiment 18 shown in FIG. 22 will be denoted by respectively the same signs and their detailed description will be dispensed with.

Referring to FIG. 23, in the image formation device U of this Embodiment 19, the arrangement of the image recording member G is inverse laterally to that of the image recording member G in Embodiment 18 shown in FIG. 22. Thus in this Embodiment 19, the transfer roller T is arranged to the left of the image carrier PR. Furthermore, the paper feed tray TR1 is configured separately from the case of the image recording member G.

This Embodiment 19 shown in FIG. 23 is the same as Embodiment 18 shown in FIG. 22 in all other aspects of configuration and actions.

Examples of Modification

Whereas preferred embodiments of the present invention have hitherto been described in detail, the invention is not limited to these embodiments and can be modified in various ways without deviating from the true spirit and scope of the invention as stated in the appended claims. Some examples of modification are described below.

The invention can be applied to image formation devices other than printers and monochromic copying machines, such as color copying machines, facsimiles and multifunctional machines.

The invention can be applied to image writing devices other than laser writing devices, such as liquid crystal panels and light emitting diodes, or image formation devices using fluorescent indicator tubes, ink jet recording heads and the like.

The image formation devices according to the invention so far described can provide the following advantages.

Since they can detect, in a double side job, the sheet size before recording on the first side of a sheet and that before recording on the second side using the same sheet size detecting members, errors in detecting the size of sheets on which images are to be recorded can be reduced.

They permit detection of the sheet size in a short period of time on a sheet size detecting path on which sheets are held in a planar shape and, at the same time, the accuracy of detection can be enhanced.

The entire disclosure of Japanese Patent Application No. 2003-080779 filed on Mar. 24, 2003 including specification, claims, drawings and abstract is incorporated herein by reference in its entirety.

What is claimed is:

1. An image forming apparatus for duplex printing comprising:

a sheet size detector that detects a size of the sheet before image forming and a size of the sheet on a first side of which an image has been formed;

a controller that controls image forming onto a second side of the sheet according to the difference between the size of the sheet before image forming and the size of the sheet on the first side of which an image has been formed detected by the sheet size detector.

2. An image formation device comprising:

an upstream side sheet carrying path that carries a sheet to an image forming position;

a downstream side sheet carrying path that carries the sheet which is passed through the image forming position to an eject tray;

a sheet returning path that inverts the sheet on a first side of which an image has been formed and returns the inverted sheet to the upstream side sheet carrying path;

a sheet size detector disposed on the upstream side carrying path, the sheet size detector detecting a size of the sheet before image forming and a size of the inverted sheet on the first side of which the image has been formed;

an image correction magnification computing/memory part that computes and stores an image magnification (b/a), wherein a is the size of the sheet before image forming detected by the sheet size detector and b is the size of the inverted sheet on the first side of which the image has been formed, and the image magnification (b/a) is an image magnification of an image to be formed on a second side of the sheet to the image formed on the first side of the sheet; and a control part that controls the image forming onto the second side of the sheet based on the computed image magnification (b/a).

3. The image formation device according to claim 2, further comprising:

a sheet carrying member that carries sheets while holding them in a planar shape along the upstream side sheet carrying path on which the sheet size detector is arranged; wherein the sheet size detector detects a sheet length and a sheet width, wherein the sheet length is the length in a carrying direction of sheets and the sheet width is the length in a sheet width direction perpendicular to the carrying direction, and the sheet is held in the planar shape along the upstream side sheet carrying path on which the sheet size detector is disposed.

4. The image formation device according to claim 3, wherein the sheet size detector further comprises a sheet end passage detector for detecting passage of one end of a sheet in the carrying direction, the sheet is held in the planar shape on the upstream side sheet carrying path on which the sheet size detector is disposed, and another sheet end passage detector for detecting another end position of the sheet when the sheet end passage detector has detected the passage of the one sheet end.

5. The image formation device according to claim 4, wherein the image formation device further comprises a plurality of the sheet end passage detectors which are disposed based on a plurality of sheet sizes.

6. The image formation device according to claim 2, further comprising:

an upstream side sheet direct carrying path that directly supplies sheets separated by a paper feed member to the image forming position instead of feeding them by way of the upstream side sheet carrying path on which the sheet size detector is disposed.

7. The image formation device according to claim 2, further comprising:

a paper feed tray that feeds sheets in a regular feeding direction, the sheets being taken out by a take-out roller, the paper feed tray also feeding sheets in a direct paper feeding direction which is reverse to the regular feeding direction;

a direct paper feed member that separates on a one-by-one basis the sheets fed in the direct paper feeding direction and feeds the sheets downstream in a sheet carrying direction; and an upstream side sheet direct carrying path which directly carries the sheets separated by the direct paper feed member to the image forming position not by way of the upstream side sheet carrying path on which the sheet size detector is disposed.

8. The image formation device according to claim 2, wherein the image formation device further comprises a take-out roller which takes out sheets accommodated in a paper feed tray and feeds them in either a regular feeding direction or a direct paper feeding direction which is reverse to the regular feeding direction.

9. The image formation device according to claim 2, further comprising:

a second paper feed tray which, apart from a first paper feed tray in which sheets to be carried to the image forming position via the upstream side sheet carrying path on which the sheet size detector is disposed are accommodated, accommodates sheets to be directly supplied to the image forming position not by way of the upstream side sheet carrying path on which the sheet size detector is disposed;

a take-out roller which can take out sheets accommodated in the second paper feed tray and carry them in a paper feeding direction;

a paper feed member which separates on a one-by-one basis sheets taken out of the second paper feed tray and feeds them downstream in a sheet carrying direction; and a second upstream side sheet carrying path along which sheets separated by the paper feed member are directly supplied to the image forming position not by way of the upstream side sheet carrying path on which the sheet size detector is disposed.

10. The image formation device according to claim 9, wherein the first paper feed tray and the second paper feed tray accommodate the same size sheets and a replenishing paper feed path supplies the sheets from one of the first paper feed tray and the second paper feed tray to the other.

11. The image formation device according to claim 10, wherein the first paper feed tray and the second paper feed tray are arranged adjacent to each other, and the first paper feed tray and the second paper feed tray supply the sheets directly from one to the other tray not by way of any sheet carrying path.

12. The image formation device according to claim 2, wherein the sheet returning path further comprises:

a sheet inverting part that inverts the sheet on the first side of which the image has been formed; and a sheet returning part that returns the inverted sheet to the upstream side sheet carrying path.

13. An image formation device comprising:

a paper feed member that separates on a one-by-one basis sheets taken out of a paper feed tray by a take-out roller and feeds them downstream in a sheet carrying direction;

an upstream side sheet carrying path along which sheets separated by the paper feed member are carried to an image forming position;

an image forming member that forms an image on a first side of a sheet passing the image forming position according to image forming member drive data;

a downstream side sheet carrying path that carries the sheet on the first side of which the image has been formed to an eject tray;

a sheet returning path that inverts the sheet on the first side of which the image has been formed, and returns the inverted sheet to the upstream side sheet carrying path;

an image scanner which is arranged on the upstream side sheet carrying path, and reads the images formed on the first side of the sheet carried along the upstream side sheet carrying path and size of the sheet;

a sheet size detecting part that detects the size of the sheet according to a sheet size detecting signal from the image scanner;

an image correction magnification computing/memory part which, where a represents the size of the sheet before image forming detected by the image scanner and b represents the size of the sheet on the first side of which the image has been formed, computes an image magnification for forming an image on a second side of the sheet relative to the image formed on the first side of the sheet according to a and b, and stores the computed image magnification; and an image forming member control part which supplies an operation control signal for the image forming member at the time of image forming onto the second side of the sheet according to the computed image magnification.

14. The image formation device according to claim 13, further comprising:

an upstream side sheet direct carrying path along which sheets separated by the paper feed member are directly supplied to the image forming position not by way of the upstream side sheet carrying path on which the sheet size detector is disposed.

15. An image forming method for a duplex printing apparatus having a sheet size detector for detecting a size of a sheet before image forming and a size of the sheet on a first side of which an image has been formed, the method comprising:

detecting a size of the sheet at a detecting position upstream of an image forming position;

forming an image on the first side of the sheet at the image forming position;

returning the sheet on the first side of which the image has been formed to the detecting position;

secondly detecting a size of the sheet on the first side of which the image has been formed at the detecting position;

computing an image magnification (b/a), where a is the size of the sheet before image forming and b is the size of the sheet formed on the first side, and forming an image on the second side of the sheet based on the image magnification (b/a).

* * * * *